US007774972B2

(12) United States Patent
Potterfield et al.

(10) Patent No.: US 7,774,972 B2
(45) Date of Patent: Aug. 17, 2010

(54) MODULAR SHOOTING RESTS AND SHOOTING REST ASSEMBLIES

(75) Inventors: Russell A. Potterfield, Columbia, MO (US); David Yale, Santa Clara, CA (US)

(73) Assignee: Battenfeld Technologies, Inc., Columbia, MO (US)

( * ) Notice: Subject to any disclaimer, the term of this patent is extended or adjusted under 35 U.S.C. 154(b) by 63 days.

(21) Appl. No.: 11/853,745

(22) Filed: Sep. 11, 2007

(65) Prior Publication Data

US 2008/0168697 A1 Jul. 17, 2008

Related U.S. Application Data

(60) Provisional application No. 60/843,971, filed on Sep. 11, 2006.

(51) Int. Cl.
*F41C 27/00* (2006.01)

(52) U.S. Cl. ..... 42/94; 89/37.04

(58) Field of Classification Search ..... 42/94; 73/167; 89/37.04

See application file for complete search history.

(56) References Cited

U.S. PATENT DOCUMENTS

| | | | |
|---|---|---|---|
| 197,397 | A | 11/1877 | O'Neil |
| 387,411 | A | 8/1888 | Gisel |
| 399,604 | A | 3/1889 | Dufner et al. |
| 499,315 | A | 6/1893 | Borchardt |
| 568,543 | A | 9/1896 | Parks |
| 668,219 | A | 2/1901 | Rock |
| 691,912 | A | 1/1902 | McClean |
| 718,865 | A | 1/1903 | Northcraft |

(Continued)

FOREIGN PATENT DOCUMENTS

| | | |
|---|---|---|
| DE | 838872 | 5/1952 |

(Continued)

OTHER PUBLICATIONS

U.S. Appl. No. 11/431,956, filed May 10, 2006, Morrow et al.

(Continued)

*Primary Examiner*—Stephen M Johnson
*Assistant Examiner*—Daniel J Troy
(74) *Attorney, Agent, or Firm*—Perkins Coie LLP

(57) ABSTRACT

Modular shooting rests and associated assemblies are disclosed herein. One embodiment of the disclosure, for example, is directed to a shooting rest assembly for supporting a firearm. The shooting rest assembly can include a first base portion and a second base portion. The first base portion has an exterior surface, an inner surface, and a bottom surface defining a bottom surface plane. The first base portion also includes an inner volume defined, at least in part, by the inner surface and the bottom surface plane. The second base portion is engaged with the first base portion in a configuration selected from (a) a first shooting rest arrangement, and (b) a second shooting rest arrangement. In the first shooting rest arrangement, the second base portion is received at least approximately completely within the inner volume of the first base portion in a nested configuration. In the second shooting rest arrangement, the first base portion is positioned to support a first section of the firearm and the second base portion is positioned to support a second section of the firearm.

19 Claims, 7 Drawing Sheets

U.S. PATENT DOCUMENTS

| | | | | |
|---|---|---|---|---|
| 778,865 | A | | 1/1905 | Hyenga |
| 789,909 | A | | 5/1905 | Herold |
| 1,033,624 | A | | 7/1912 | Schmeisser |
| 1,061,577 | A | | 5/1913 | Whitney |
| 1,088,362 | A | | 2/1914 | Perkins |
| 1,089,307 | A | | 3/1914 | Benet et al. |
| 1,121,945 | A | | 12/1914 | Smith |
| 1,145,585 | A | | 7/1915 | Hebard |
| 1,175,692 | A | | 3/1916 | Boicourt |
| 1,187,325 | A | | 6/1916 | Ivey |
| 1,195,777 | A | | 8/1916 | Burtin |
| 1,250,215 | A | | 12/1917 | Panos |
| 1,256,255 | A | | 2/1918 | Porter |
| 1,295,688 | A | | 2/1919 | Butler |
| 1,367,353 | A | | 2/1921 | Craig |
| 1,488,647 | A | | 4/1924 | Quinn |
| 1,639,722 | A | | 8/1927 | Whitney |
| 1,693,289 | A | | 11/1928 | Warren |
| 1,736,244 | A | | 11/1929 | Baker |
| 1,902,040 | A | | 3/1933 | Meyer |
| 1,907,181 | A | | 5/1933 | Fey |
| 1,927,876 | A | | 9/1933 | Meyer |
| 1,928,871 | A | | 10/1933 | Swebilius |
| 2,066,218 | A | | 12/1936 | Morgan |
| 2,079,510 | A | | 5/1937 | King et al. |
| 2,090,930 | A | | 8/1937 | Chubb |
| 2,100,514 | A | | 11/1937 | Miller |
| 2,121,982 | A | | 6/1938 | Pugsley |
| 2,125,353 | A | | 8/1938 | Mattson |
| 2,216,766 | A | | 10/1940 | Cook |
| 2,232,743 | A | | 2/1941 | Swenson |
| 2,297,993 | A | | 10/1942 | Tratsch |
| 2,331,372 | A | | 10/1943 | Buchanan |
| 2,378,545 | A | | 6/1945 | Fraser et al. |
| D147,305 | S | | 8/1947 | Sloan |
| 2,432,519 | A | | 12/1947 | Garand |
| 2,451,266 | A | | 10/1948 | Whittemore |
| 2,455,644 | A | | 12/1948 | Barnes |
| 2,476,078 | A | | 7/1949 | Banks |
| 2,479,354 | A | | 8/1949 | Hanson |
| 2,483,089 | A | | 9/1949 | Ferguson |
| 2,484,801 | A | | 10/1949 | Anderson |
| 2,508,951 | A | | 5/1950 | Kazimier |
| 2,510,380 | A | | 6/1950 | Clifford |
| 2,517,268 | A | | 8/1950 | Wilson |
| 2,638,676 | A | | 5/1953 | Callahan |
| 2,677,207 | A | | 5/1954 | Stewart |
| 2,701,930 | A | | 2/1955 | Dolan |
| 2,731,829 | A | | 1/1956 | Wigington et al. |
| 2,740,530 | A | | 4/1956 | Ponder |
| 2,753,642 | A | | 7/1956 | Sullivan |
| 2,774,563 | A | * | 12/1956 | Pribis ..... 248/127 |
| 2,795,881 | A | | 6/1957 | Bellows |
| 2,813,376 | A | | 11/1957 | Middlemark |
| 2,817,233 | A | | 12/1957 | Dower et al. |
| 2,821,117 | A | | 1/1958 | Hultgren |
| 2,847,909 | A | | 8/1958 | Kester |
| 2,867,931 | A | | 1/1959 | Schreiber |
| 2,877,689 | A | | 3/1959 | Pribis |
| 2,894,347 | A | | 7/1959 | Woodcock |
| 2,924,881 | A | | 2/1960 | Gee |
| 2,924,904 | A | | 2/1960 | Amsler |
| 2,924,914 | A | | 2/1960 | Garwood |
| 2,975,540 | A | | 3/1961 | Lewis |
| 2,999,788 | A | | 9/1961 | Morgan |
| 3,011,283 | A | | 12/1961 | Lunn et al. |
| 3,012,350 | A | | 12/1961 | Wold |
| 3,023,527 | A | | 3/1962 | Leek et al. |
| 3,024,653 | A | | 3/1962 | Broadway |
| 3,041,938 | A | | 7/1962 | Seabrook |
| 3,055,655 | A | | 9/1962 | Chelf |
| 3,060,612 | A | | 10/1962 | Brown et al. |
| 3,112,567 | A | | 12/1963 | Flanagan |
| 3,125,929 | A | | 3/1964 | Peasley |
| 3,128,668 | A | | 4/1964 | Dicken |
| 3,163,420 | A | | 12/1964 | Braun |
| 3,175,456 | A | | 3/1965 | Goodsell |
| 3,183,617 | A | | 5/1965 | Ruger et al. |
| 3,206,885 | A | | 9/1965 | Dye |
| 3,225,656 | A | | 12/1965 | Flaherty et al. |
| D203,680 | S | | 2/1966 | Benchrest |
| 3,240,103 | A | | 3/1966 | Lamont |
| 3,259,986 | A | | 7/1966 | Carr |
| 3,283,425 | A | | 11/1966 | Boyd |
| 3,283,643 | A | | 11/1966 | Mittelsteadt |
| 3,291,317 | A | | 12/1966 | Bowen |
| 3,292,293 | A | | 12/1966 | Chiasera et al. |
| 3,320,848 | A | | 5/1967 | Ponsness |
| 3,323,246 | A | | 6/1967 | Loffler |
| 3,327,422 | A | | 6/1967 | Harris |
| 3,330,561 | A | | 7/1967 | Kandel |
| 3,343,411 | A | | 9/1967 | Lee |
| 3,353,827 | A | | 11/1967 | Dun, Jr. |
| 3,370,852 | A | | 2/1968 | Kandel |
| 3,406,969 | A | | 10/1968 | Tisdell et al. |
| 3,423,092 | A | | 1/1969 | Kandel |
| D215,311 | S | | 9/1969 | Born |
| 3,486,752 | A | | 12/1969 | Colvin |
| 3,499,525 | A | | 3/1970 | Kanter |
| 3,510,951 | A | | 5/1970 | Dow |
| 3,513,604 | A | | 5/1970 | Matsunaga et al. |
| 3,550,941 | A | | 12/1970 | Spiro et al. |
| 3,556,666 | A | | 1/1971 | Lichenstern |
| D220,154 | S | | 3/1971 | Irelan |
| 3,572,712 | A | | 3/1971 | Vick |
| 3,580,127 | A | | 5/1971 | Lee |
| 3,583,556 | A | | 6/1971 | Wagner |
| 3,584,820 | A | | 6/1971 | Butcher, Sr. |
| 3,587,193 | A | | 6/1971 | Lewis |
| 3,608,225 | A | | 9/1971 | Manuel |
| 3,680,266 | A | | 8/1972 | Shiplov |
| 3,680,354 | A | | 8/1972 | Phillips, Jr. |
| 3,711,955 | A | | 1/1973 | Holt |
| 3,711,984 | A | | 1/1973 | Dyer et al. |
| 3,739,515 | A | | 6/1973 | Koon, Jr. |
| 3,744,292 | A | | 7/1973 | Michelson |
| 3,745,875 | A | | 7/1973 | Kennedy et al. |
| 3,748,950 | A | | 7/1973 | Huntington |
| 3,764,219 | A | | 10/1973 | Collins |
| 3,769,758 | A | | 11/1973 | McDonald |
| 3,813,816 | A | | 6/1974 | Funk |
| 3,815,270 | A | | 6/1974 | Pachmayr |
| 3,826,559 | A | | 7/1974 | Berliner et al. |
| 3,827,172 | A | | 8/1974 | Howe |
| 3,842,527 | A | | 10/1974 | Low |
| D233,853 | S | | 12/1974 | Ferrara |
| 3,877,178 | A | | 4/1975 | Campanelli |
| 3,885,357 | A | | 5/1975 | Hoyt |
| 3,893,266 | A | | 7/1975 | Anderson et al. |
| 3,895,803 | A | | 7/1975 | Loe |
| 3,899,175 | A | | 8/1975 | Loe |
| D237,106 | S | | 10/1975 | Baljet et al. |
| 3,913,746 | A | | 10/1975 | Burton |
| 3,914,879 | A | | 10/1975 | Taylor, III et al. |
| 3,935,657 | A | | 2/1976 | Wade |
| 3,947,988 | A | | 4/1976 | Besaw |
| 3,949,987 | A | | 4/1976 | Candor |
| 3,961,436 | A | | 6/1976 | Hagen et al. |
| 3,964,613 | A | | 6/1976 | Anderson, Jr. |
| 3,979,849 | A | | 9/1976 | Haskins |
| 4,007,554 | A | | 2/1977 | Helmstadter |
| 4,012,860 | A | | 3/1977 | Auger |
| 4,021,971 | A | | 5/1977 | McFadden |
| 4,026,057 | A | | 5/1977 | Cady |

4,027,781 A 6/1977 Covert
4,042,242 A 8/1977 Nicholls et al.
4,054,288 A 10/1977 Perrine, Sr.
4,055,016 A 10/1977 Katsenes
4,072,313 A 2/1978 Murso et al.
4,076,247 A 2/1978 Kim et al.
4,120,108 A 10/1978 Vickers et al.
4,120,276 A 10/1978 Curran
4,122,623 A 10/1978 Stice
4,143,491 A 3/1979 Blanc
4,177,608 A 12/1979 Balz
4,188,855 A 2/1980 Alberts
4,203,600 A 5/1980 Brown
4,206,573 A 6/1980 Hayward
4,222,305 A 9/1980 Lee
4,223,588 A 9/1980 Simpson
4,233,748 A 11/1980 Ford et al.
D257,687 S 12/1980 Bechtel
4,266,748 A 5/1981 Dalton
4,282,671 A 8/1981 Wood et al.
D260,650 S 9/1981 Alviti
D261,794 S 11/1981 Bechtel
4,301,625 A 11/1981 Rampe
4,312,146 A 1/1982 Koon, Jr.
4,332,185 A 6/1982 Hargrove
4,333,385 A 6/1982 Culver
4,338,726 A 7/1982 Swailes
4,340,370 A 7/1982 Marshall et al.
4,345,398 A 8/1982 Pickett
4,346,530 A 8/1982 Stewart et al.
4,359,833 A 11/1982 Pachmayr et al.
4,385,464 A 5/1983 Casull
4,385,545 A 5/1983 Duer
4,391,058 A 7/1983 Casull
4,392,321 A 7/1983 Bosworth
4,407,379 A 10/1983 Pryor et al.
4,409,751 A 10/1983 Goda et al.
4,438,913 A 3/1984 Hylla
4,449,314 A 5/1984 Sorensen
4,462,598 A 7/1984 Chalin et al.
4,477,082 A 10/1984 McKenzie et al.
4,480,411 A 11/1984 Balz et al.
4,506,466 A 3/1985 Hall
4,508,508 A 4/1985 Theodore
4,512,101 A 4/1985 Waterman, Jr.
4,522,102 A 6/1985 Pickens
4,526,084 A 7/1985 David et al.
4,542,677 A 9/1985 Lee
4,548,392 A 10/1985 Rickling
4,558,531 A 12/1985 Kilby
D283,561 S 4/1986 Geist et al.
4,601,124 A 7/1986 Brown, Jr.
4,608,762 A 9/1986 Varner
4,621,563 A 11/1986 Poiencot
4,625,620 A 12/1986 Harris
4,632,008 A 12/1986 Horner
4,644,987 A 2/1987 Kiang et al.
4,648,191 A 3/1987 Goff et al.
4,653,210 A 3/1987 Poff, Jr.
4,671,364 A 6/1987 Fink et al.
4,674,216 A 6/1987 Ruger et al.
4,695,060 A 9/1987 Pilgrim
4,696,356 A 9/1987 Ellion et al.
4,702,029 A 10/1987 DeVaul et al.
4,723,472 A 2/1988 Lee
4,729,186 A 3/1988 Rieger et al.
4,751,963 A 6/1988 Bui et al.
D297,855 S 9/1988 Ruger et al.
4,776,471 A 10/1988 Elkins
4,790,079 A 12/1988 Meyers
4,790,096 A 12/1988 Gibson et al.
4,799,324 A 1/1989 Nodo
4,807,381 A 2/1989 Southard
4,815,593 A 3/1989 Brown
4,819,359 A 4/1989 Bassett
4,821,422 A 4/1989 Porter
4,821,443 A 4/1989 Bianco et al.
4,823,673 A 4/1989 Downing
4,824,086 A 4/1989 Rickling et al.
4,841,839 A 6/1989 Stuart
4,850,151 A 7/1989 Ditscherlein
4,854,066 A 8/1989 Canterbury, Sr.
4,862,567 A 9/1989 Beebe
D304,223 S 10/1989 Ruger et al.
4,873,777 A 10/1989 Southard
4,890,847 A 1/1990 Cartee et al.
4,896,446 A 1/1990 Gregory
D306,234 S 2/1990 Ferstl et al.
4,903,425 A 2/1990 Harris
4,910,904 A 3/1990 Rose
4,918,825 A 4/1990 Lesh et al.
4,921,256 A 5/1990 Gearhart
4,923,402 A 5/1990 Marshall et al.
4,924,616 A 5/1990 Bell et al.
4,937,965 A 7/1990 Narvaez
D310,302 S 9/1990 Southard
4,967,497 A 11/1990 Yakscoe
4,971,208 A 11/1990 Reinfried, Jr. et al.
4,972,619 A 11/1990 Eckert
D313,886 S 1/1991 Southard
4,987,694 A 1/1991 Lombardo
4,998,367 A 3/1991 Leibowitz
4,998,944 A 3/1991 Lund
5,005,657 A 4/1991 Ellion et al.
5,009,021 A 4/1991 Nelson
5,014,793 A 5/1991 Germanton et al.
5,031,348 A 7/1991 Carey
5,050,330 A 9/1991 Pilgrim et al.
5,058,302 A 10/1991 Minneman
5,060,410 A 10/1991 Mueller
5,063,679 A 11/1991 Schwandt
5,067,268 A 11/1991 Ransom
5,070,636 A 12/1991 Mueller
5,074,188 A 12/1991 Harris
5,081,783 A 1/1992 Jarvis
5,117,850 A 6/1992 Money
5,123,194 A 6/1992 Mason
5,125,389 A 6/1992 Paff
5,149,900 A * 9/1992 Buck ..... 42/94
5,173,563 A 12/1992 Gray
5,180,874 A 1/1993 Troncoso, Jr .
5,185,927 A 2/1993 Rivers
5,186,468 A 2/1993 Davies
5,188,371 A 2/1993 Edwards
D335,896 S 5/1993 Evenson
5,211,404 A 5/1993 Grant
5,221,806 A 6/1993 Chaney et al.
5,222,306 A 6/1993 Neumann
5,228,887 A 7/1993 Mayer et al.
5,233,779 A 8/1993 Shaw
5,235,764 A 8/1993 Perazzi et al.
5,237,778 A 8/1993 Baer
5,247,758 A 9/1993 Mason
5,271,175 A 12/1993 West, III
5,275,890 A 1/1994 Wolf et al.
5,287,643 A 2/1994 Arizpe-Gilmore
5,311,693 A 5/1994 Underwood
5,315,781 A 5/1994 Beisner
5,316,579 A 5/1994 McMillan et al.
5,317,826 A 6/1994 Underwood
5,320,217 A 6/1994 Lenarz
5,328,029 A 7/1994 Chow et al.
5,332,185 A 7/1994 Walker, III
5,333,829 A * 8/1994 Bell et al. ..... 248/634
5,335,578 A 8/1994 Lorden et al.
5,344,012 A 9/1994 Matthews 5,347,740 A 9/1994 Rather et al.
5,351,428 A 10/1994 Graham
5,358,254 A 10/1994 Yeh et al.
5,361,505 A 11/1994 Faughn
5,367,232 A 11/1994 Netherton et al.
5,370,240 A 12/1994 Hand
5,375,337 A 12/1994 Butler
5,375,377 A 12/1994 Kenton
5,377,437 A 1/1995 Underwood
5,392,553 A 2/1995 Carey
5,402,595 A 4/1995 Tamllos
5,406,733 A 4/1995 Tarlton et al.
5,410,833 A 5/1995 Paterson
5,414,949 A 5/1995 Peebles
D359,392 S 6/1995 Bellington
5,421,115 A 6/1995 McKay
5,433,010 A 7/1995 Bell
5,435,223 A 7/1995 Blodgett et al.
5,442,860 A 8/1995 Palmer
D362,116 S 9/1995 Bellington et al.
D364,080 S 11/1995 Weyrauch
5,481,817 A 1/1996 Parker
5,482,241 A 1/1996 Oglesby
5,486,135 A 1/1996 Arpaio
5,490,302 A 2/1996 Dion
5,491,921 A 2/1996 Allen
5,497,557 A 3/1996 Martinsson et al.
5,497,575 A 3/1996 Fried et al.
5,501,467 A 3/1996 Kandel
D369,904 S 5/1996 Taylor
5,545,855 A 8/1996 Stanfield et al.
5,562,208 A 10/1996 Hasler et al.
D375,538 S 11/1996 Minneman
5,570,513 A 11/1996 Peterson
5,580,063 A 12/1996 Edwards
5,600,913 A 2/1997 Minneman
5,617,666 A 4/1997 Scott
5,622,344 A 4/1997 Gracie
5,628,135 A 5/1997 Cady
5,640,944 A 6/1997 Minneman
5,644,862 A 7/1997 Folmer
5,649,465 A 7/1997 Beebe
5,653,625 A 8/1997 Pierce et al.
5,661,919 A 9/1997 Pryor
5,662,516 A 9/1997 You
5,666,757 A 9/1997 Helmstadter
D387,123 S 12/1997 Hughes et al.
5,703,317 A 12/1997 Levilly et al.
5,711,102 A 1/1998 Plaster et al.
5,715,625 A 2/1998 West, III
D391,616 S 3/1998 Plybon
5,723,183 A 3/1998 Williams et al.
5,723,806 A 3/1998 Odom
5,737,865 A 4/1998 Brandl et al.
5,740,625 A 4/1998 Jenkins
5,758,447 A 6/1998 Venetz
5,761,954 A 6/1998 Dvorak
5,778,589 A 7/1998 Teague
5,779,527 A 7/1998 Maebashi
5,811,720 A 9/1998 Quinnell et al.
5,813,131 A 9/1998 Werre
5,815,974 A 10/1998 Keng
5,833,308 A 11/1998 Strong, III et al.
D403,176 S 12/1998 Harper
5,857,279 A 1/1999 de Oliveira Masina et al.
5,875,580 A 3/1999 Hill et al.
5,878,504 A 3/1999 Harms
5,884,966 A 3/1999 Hill et al.
5,899,329 A 5/1999 Hu et al.
5,907,919 A 6/1999 Keeney
5,913,667 A 6/1999 Smilee
5,913,668 A 6/1999 Messer
5,924,694 A 7/1999 Kent
5,930,932 A 8/1999 Peterson
5,933,997 A 8/1999 Barrett
5,933,999 A 8/1999 McClure et al.
5,959,613 A 9/1999 Rosenberg et al.
5,970,642 A 10/1999 Martin
5,974,719 A 11/1999 Simonek
6,019,375 A 2/2000 West, Jr.
6,021,891 A 2/2000 Anderson
6,044,747 A 4/2000 Felts
6,058,641 A 5/2000 Vecqueray
6,073,381 A 6/2000 Farrar et al.
6,086,375 A 7/2000 Legros
6,110,020 A 8/2000 Rolfi
6,121,556 A 9/2000 Cole
6,237,462 B1 5/2001 Hawkes et al.
6,254,100 B1 7/2001 Rinehart
6,260,463 B1 7/2001 Brand et al.
6,283,428 B1 9/2001 Maples et al.
6,289,622 B1 9/2001 Desch, Jr. et al.
6,293,041 B2 9/2001 Weaver
6,294,759 B1 9/2001 Dunn, Jr.
6,305,117 B1 10/2001 Hales, Sr.
6,309,476 B1 10/2001 Ravenscroft et al.
6,338,218 B1 1/2002 Hegler
6,390,294 B1 5/2002 Fiore, Jr. et al.
6,397,720 B1 6/2002 Fox et al.
6,439,515 B1 8/2002 Powers
6,439,530 B1 8/2002 Schoenfish et al.
6,517,133 B2 2/2003 Seegmiller et al.
D471,248 S 3/2003 Jacobs
6,526,687 B1 3/2003 Looney
D473,376 S 4/2003 Abate
6,546,662 B1 4/2003 Chong
6,574,899 B1 6/2003 Mostello
6,575,469 B2 6/2003 Love
6,643,973 B1 11/2003 Smith
6,663,298 B2 12/2003 Haney
6,688,031 B2 2/2004 Steele
6,736,400 B1 5/2004 Cesternino
6,813,855 B2 11/2004 Pinkley
6,814,654 B2 11/2004 Rolfi
6,854,975 B2 2/2005 Ranzinger
6,860,054 B1 * 3/2005 Mosher ..... 42/94
6,862,833 B1 3/2005 Gurtner
6,871,440 B2 3/2005 Highfill et al.
6,877,266 B1 4/2005 Brownlee
6,883,263 B1 4/2005 Carrow
6,931,777 B1 8/2005 Krien
6,953,114 B2 10/2005 Wang et al.
D513,055 S 12/2005 Lahti
6,978,569 B2 12/2005 Williamson, IV et al.
D519,183 S 4/2006 Minneman
7,032,494 B2 4/2006 Wygant
D521,100 S 5/2006 Morrow
7,062,979 B2 6/2006 Day et al.
D524,541 S 7/2006 Cauley
7,086,192 B2 8/2006 Deros
7,104,398 B1 9/2006 Wisecarver
7,134,663 B1 11/2006 Lowe et al.
7,143,986 B1 12/2006 Austin et al.
7,152,355 B2 12/2006 Fitzpatrick et al.
7,152,358 B1 12/2006 LeAnna et al.
D540,904 S 4/2007 Werner
7,207,567 B1 4/2007 Brown et al.
7,225,050 B2 5/2007 Sutula, Jr.
D553,219 S 10/2007 Potterfield
D567,895 S 4/2008 Cauley
7,357,250 B2 4/2008 Hagemann et al.
7,363,740 B2 4/2008 Kincel
7,401,431 B2 7/2008 Pierce et al.
D576,245 S 9/2008 Potterfield et al.
7,426,800 B2 9/2008 Pierce et al.
7,584,690 B2 9/2009 Cauley

| | | | | |
|---|---|---|---|---|
| 2002/0113372 | A1 | 8/2002 | Love | |
| 2004/0020097 | A1 | 2/2004 | Deros | |
| 2004/0134113 | A1 | 7/2004 | Deros et al. | |
| 2005/0000141 | A1 | 1/2005 | Cauley et al. | |
| 2005/0011101 | A1 | 1/2005 | Gooder | |
| 2005/0115137 | A1* | 6/2005 | Minneman | 42/94 |
| 2005/0183319 | A1 | 8/2005 | Franks | |
| 2005/0188597 | A1 | 9/2005 | Keng et al. | |
| 2005/0242250 | A1 | 11/2005 | Keng et al. | |
| 2006/0174532 | A1 | 8/2006 | Popikow | |
| 2006/0175213 | A1 | 8/2006 | Hurt et al. | |
| 2006/0218840 | A1 | 10/2006 | Cauley | |
| 2006/0248774 | A1 | 11/2006 | Pierce et al. | |
| 2006/0248775 | A1 | 11/2006 | Wade et al. | |
| 2006/0254111 | A1 | 11/2006 | Giauque et al. | |
| 2006/0278797 | A1 | 12/2006 | Keng et al. | |
| 2007/0029733 | A1 | 2/2007 | Anderson | |
| 2007/0046760 | A1 | 3/2007 | Zara | |
| 2007/0068379 | A1 | 3/2007 | Sween et al. | |
| 2007/0074439 | A2 | 4/2007 | Cauley et al. | |
| 2007/0074440 | A2 | 4/2007 | Cauley | |
| 2007/0094911 | A1 | 5/2007 | Rush et al. | |
| 2007/0113460 | A1 | 5/2007 | Potterfield et al. | |
| 2007/0175077 | A1 | 8/2007 | Laney et al. | |
| 2007/0256346 | A1 | 11/2007 | Potterfield et al. | |
| 2007/0262529 | A1 | 11/2007 | Gamez et al. | |
| 2007/0266610 | A1 | 11/2007 | Coffield | |
| 2007/0294929 | A1 | 12/2007 | Potterfield et al. | |
| 2007/0295197 | A1 | 12/2007 | Potterfield | |
| 2008/0023379 | A1 | 1/2008 | Potterfield et al. | |
| 2008/0023915 | A1 | 1/2008 | Morrow et al. | |
| 2008/0034636 | A1 | 2/2008 | Potterfield et al. | |
| 2008/0041700 | A1 | 2/2008 | Potterfield et al. | |
| 2008/0047189 | A1 | 2/2008 | Potterfield et al. | |
| 2008/0054570 | A1 | 3/2008 | Potterfield et al. | |
| 2008/0061509 | A1 | 3/2008 | Potterfield | |
| 2008/0127815 | A1 | 6/2008 | Yale et al. | |
| 2008/0174071 | A1 | 7/2008 | Potterfield et al. | |
| 2009/0049731 | A1 | 2/2009 | Seuk | |
| 2009/0056192 | A1 | 3/2009 | Oz | |
| 2009/0126250 | A1 | 5/2009 | Keng | |

FOREIGN PATENT DOCUMENTS

| | | |
|---|---|---|
| EP | 0624455 | 11/1994 |
| GB | 475080 | 11/1937 |

OTHER PUBLICATIONS

U.S. Appl. No. 11/505,784, filed Aug. 16, 2006, Cauley.
U.S. Appl. No. 11/679,832, filed Feb. 27, 2007, Cauley et al.
U.S. Appl. No. 11/739,077, filed Apr. 23, 2007, Cauley et al.
U.S. Appl. No. 11/801,341, filed Apr. 23, 2007, Potterfield et al.
U.S. Appl. No. 11/862,821, filed Sep. 27, 2007, Cesternino.
U.S. Appl. No. 11/935,381, filed Nov. 5, 2007, Potterfield.
U.S. Appl. No. 11/937,466, filed Nov. 8, 2007, Potterfield et al.
U.S. Appl. No. 12/037,336, filed Feb. 26, 2008, Potterfield.
U.S. Appl. No. 12/117,668, filed May 8, 2008, Potterfield et al.
U.S. Appl. No. 12/172,848, filed Jul. 14, 2008, Cesternino et al.
U.S. Appl. No. 12/177,032, filed Jul. 21, 2008, Potterfield et al.
"American Rifleman: What to do about recoil," LookSmart, http://www.findarticles.com/p/articles/mi_qa3623/is_199907/ai_n8861959/print, pp. 1-4 [Internet accessed on Jan. 4, 2006].
"Cleaning Cradles: Sinclaire Cleaning Cradles," p. 21, The date on which the Sinclair Folding Cleaning Cradle was first on sale is not known, but is believed to be circa 2004.
"Decker Rifle Vise," 1 page, the date on which the Decker Rifle Vise was first on sale is not known but is believed to be circa 2004.
Amazon.com, "Eforcity Magnetic Screwdriver Set w/15 bits; Great for Cellphones, Computers; Includes: T6, Torx, Security Torx, Philips, Slotted, Spanner, Tri-Wing, Bent Pry Tool, Round Awl, Reset Pin for Game Boy Advance, Nintendo WII, DS Lite, NDS Apple TV," 1 page [Internet accessed on Sep. 18, 2007].
Battenfeld Technologies, Inc., "Gun Vise," Tipton Gun Cleaning Supplies, Battenfeld Technologies, Inc. 2004 Catalog, p. 32, Product No. 782-731, 2 pgs.
"The Grabber and Hustler '76," MEC—Mayville Engineering Company, Inc., 2 pgs., undated.
1shop2.com "Hoppe's Gunsmith's Fully Adjustable Bench Vise," http://www.1shop2.com/outdoor_sports/Hoppe's—Gunsmith's-Fully-Adj . . ., 3 pgs, the date on which The Hoppe's Gunsmith's Fully Adjustable Bench Vise was first on sale is not known, but is believed to be circa 2004.
AcuSport, Outdoor Sporting Products, 3 pgs., undated.
Battenfeld Technologies, Inc., "Steady Rest Portable Shooting Rest," 1 page [Internet accessed Jan. 25, 2006].
Birchwood Casey 2005 Catalog, 28 pages.
Birchwood Casey 2006 Catalog, pp. 5-17.
Birchwood Casey, "Dirty Bird® Splattering Targets," http://www.birchwoodcasey.com/sport/target_index.asp?categoryID=4&subcat=22, pp. 1-4 [Internet accessed Jan. 16, 2006].
Birchwood Casey, "Shoot•N•C® Targets," http://www.birchwoodcasey.com/sport/target_index.asp?categoryID=4&subcat=8, pp. 1-8 [Internet accessed Jan. 16, 2006].
Birchwood Casey, "Targets Spots®," http://www.birchwoodcasey.com/sport_index.asp?categoryID=4&subcat=12, pp. 1-2 [Internet accessed Jan. 16, 2006].
Birchwood Casey, "World of Targets®," http://www.birchwoodcasey.corn/sport/target_index.asp?categoryID=4&subcat=13, pp. 1-4 [Internet accessed Jan. 16, 2006].
Brownells, Inc., "Brownells Magna-Tip Screwdriver," Brownells Catalog No. 54, 2001-2002, p. 151.
Brownells, Inc., "Brownells Magna-Tip Super-Sets," Brownells Catalog No. 54, 2001-2002, p. 153.
Brownells, Inc., Catalog No. 41, 1988-1989, 3 pgs.
Brownells, Inc., Catalog No. 47, 1994-1995, 2 pgs.
Brownells, Inc., Catalog No. 57, 2004-2005. 2 pgs.
Brownells, Inc., Sight Base Cutters, Faxed Dec. 17, 2003, 1 page.
B-Square, Pro Gunsmith Screwdriver Set, B-Square Mounts Tools Accessories Product Catalog, p. 23, date unknown.
Cabela's Master Catalog, Fall 2002, Edition II, p. 416.
Cabela'Master Catalog, Fall 2003, Late-Season Edition, p. 416.
Cabela's, "HySkore Sighting System and Cleaning Vise," The date on which the HySkore Sighting System and Cleaning Vise was first on sale is not known, but is believed to be circa Jan. 2005, however, a prototype of this product may have been shown to buyers at Cabela's circa Aug. 2004, 1 page.
Caldwell Insta-View™ 4" Targets.
Caldwell™ Shooting Supplies, Targets & Target Accessories, lnstraView™ Targets, 1 page.
Californiavarmintcallers.com—Forum, http://californiavarmintcallers.com/community/modules/newbb/viewtopic.php?topic_id=10&forum=9&PHPSESSID=074ed8c7 ..., pp. 1-4 [Internet accessed Jan. 16, 2006].
Champion Target, "Next Generation Paper Targets," http://www.championtarget.com/products/targets/next_generation_targets.aspx, pp. 1-3, [Internet accessed on Jan. 16, 2006].
Champion Traps & Target, 2005 Product Catalog, 12 pgs.
Ellett Brothers, Rests & Gun Vises, pp. 621-622, date unknown.
Lohman Sight Vise, 4 pages product photographs, the date on which the Lohman Site Vise was first on sale is not known, but is believed to be circa 2004.
Milek, B., "Handloading for Hunting" New Products from RCBS, Lee, Accurate Arms, Peterson's Hunting, Mar. 1985, p. 21.
Hyskore: Professional Shooting Accessories, "Dangerous Game Machine Rest," www.hyskore.com, 10 pgs. [Internet accessed Feb. 22, 2006].
Hyskore: Professional Shooting Accessories, "Hydraulic Trigger Release," www.hyskore.com, 7 pgs. [Internet accessed Feb. 22, 2006].
Lahti Company Brochure, "Rock Solid Hold," Rifle Evaluator, http://www.lathicompany.com/Forms/EvaluatorBrochure2.jpg, 2 pgs. [Internet accessed Jan. 16, 2006].
Lahti Company Brochure, "Rifle Evaluator: No Pain, No Fear, No Flinching, No Body Movement," www.lahticompany.com, 2 pgs., Undated.

Lee Precision, Inc., "The World's Fastest Handloading Press . . . Lee Progressive 1000," 1985 Catalog, pp. 1-15.
Lee Precision, Inc., "Load-All," 1 page.
Lyman, "A History of Lyman Metallic Reloading," Reloading Handbook, 46th Edition, pp. 10-31.
Lyman, "Introduction to Reloading," Reloading Handbook, 46th Edition, pp. 170-203.
Carmichael, J., "Reloading for Accuracy," Lyman Reloading Handbook, 46th Edition, pp. 68-77.
Midway USA, "Chapman 27-Piece Deluxe Screwdriver Set," Master Catalog #2 and Reference Guide, 2004, Product # 510-765, p. 440.
Midway USA, "Pachmayr Professional Screwdriver Set," Master Catalog #2 and Reference Guide, 2004, Product #776-936, p. 448.
Midway USA, "Wheeler Engineering Space-Saver Gunsmithing Screwdriver Set," Master Catalog #2 and Reference Guide, 2004, Product #297-593, p. 453.
Midway USA. "Tipton Range Box with Ultimate Rifle, Handgun Cleaning Kit (No Solvents)," http://www.midwayusa.com/rewriteaproduct/135086, The date on which the Tipton Range Box was first on sale is not known, but is believed to be circa 2004, 2 pages.
MTM Case-Gard, "Gun Maintenance Centers," http://www/mtmcase-gard.com/products/shooting/gunm.html, The date on which the MTM Gun Maintenance Center was first on sale is not known, but is believed to be circa 2004, 2 pages [Internet accessed Oct. 11, 2006].
MTM Case-Gard, "Rifle rest and pistol shooting rest," http://www/mtmcase-gard.com/products/shooting/shoo.html, The date on which the MTM Site-In-Clean was first on sale is not known, but is believed to be circa 2004, 3 pages [Internet accessed Oct. 11, 2006].
MTM Case-Gard, "MTM Shoulder-Gard Rifle Rest," Cover Photo for Rest, p. 2.
Caldwells Insta-View 4" Targets, 1 page [product photo].
CV-500, 3 pages [product photos].
Dillon Precision CV-500 Cartridge Case Vibratory Cleaner, 6 pages [product photos].
Lyman Hornady Case Tumbler, 3 pages [product photos].
Lyman Turbo 600 Tumbler, 3 pages [product photos].
Lyman Turbo Pro 1200 Tumbler, 2 pages [product photos].
Auto-Flo Lyman Turbo 1200 Tumbler, 2 pages [product photos].
RCBS Automatic Primer Tool, pp. 68-71, undated.
"Reloading Manual Number Ten for Rifle and Pistol," The Cartridge Components, SPEER Omark Industries, pp. 28-54.
"Shotshell reloading with a GRABBER 76," MEC—Mayville Engineering Company, Inc., pp. 1-12.
Sweeney, P "Gunsmithing: Measure Headspace," Peterson's Rifleshooter, http://www.rifleshootermag.com/gunsmithing/headspace_0612/, 4 pages [Internet Accessed Dec. 11, 2004].
Tenex Precision Co., "Recoil A-Rest-R," 4 pages [product photos].
"Plano Shooters Case, Brown Camo," The Sportman's Guide, http://www.sportmansguide.com/cb/cb.asp?a=148225, The date on which the Plano Shooters Case was first on sale is not known but is believed to be circa 2004, 3 pages [Internet accessed on Oct. 11, 2006].
Precision Shooting, Inc., Bald Eagle Front Rest, The Accurate Rifle, vol. 6, Issue No. 4, May 2003, p. 47.
Sinclair International, Sinclair Shooting Rests, Products for the Precision Shooter, 2002, Issue No. 2002-B pp. 76-78.
Device manufactured by Shooter's Ridge, a division of ATK, and available at least by late 2005, 1 page.
"Uncle Bud'S Udder Bag," http:www.unclebudscss.com/pages/Udder%20Bags.html, 2 pgs. [Internet accessed on Feb. 14, 2006].
"Uncle Bud'S Bull Bags," http:www.unclebudscss.com/pages./Bulls%20bags.html, 2 pgs. [Internet accessed on Feb. 14, 2006].
Millett, "BenchMaster Shooting Rests," 1 page, Undated.
Protektor Model, "The Original Leather Rifle and Pistol Rest," http://www.protektormodel.com/, 12 pages [Internet accessed on Feb. 14, 2006].
Edgewood Shooting Bags Catalog, http://www.edgebag.com/catalog.php, 7 pages [Internet accessed on Feb. 14, 2006].
Canadian Camo, "Gun Rest," http://media5.magma.ca/www.canadiancamo.com/catalog/product_info.php?products_id=..., 2 pages [Internet accessed on Feb. 13, 2006].
Caldwell Shooting Supplies, 2006 Catalog, pp. 18, 5, 12, 14 and 15.
Cabela's, "Secure Bench Rest," http://www.cabelas.com/cabelas/en/templates/links/link.jsp;jsessionid=4FOLP0OW2HMRLLAQBBISCOF.., © 1996-2008, 2 pages [Internet accessed on Aug. 6, 2008].
Cabela's, "Premier Rifle Rest," http://www.cabelas.com/cabelas/en/templates/links/link.jsp?id=0020904227856a&type=product&cmCat=.., © 1996-2008, 2 pages [Internet accessed on Aug. 6, 2008].
Cabela's, "Sharp Shooter Rifle Rest," http://www.cabelas.com/cabelas/en/templates/links/link.jsp?id=0005816222738a&type=product&cmCat=, © 1996-2008, 2 pages [Internet accessed on Aug. 6, 2008].
Cabela's, "Nitro Shoulder Shield Rest," http://www.cabelas.com/cabelas/en/templates/links/link.jsp?id=0040862228231a&type=product&cmCat=, © 1996-2008, 2 pages [Internet accessed on Aug. 6, 2008].
Cabela's, "Sure Shot Shooting Vise/Rest," http://www.cabelas.com/cabelas/en/templates/product/standard-itemjsp?id=00348272277..., © 1996-2008, 2 pages [Internet accessed on Jul. 15, 2008].
Cabela's, "BenchBuddy® Gun Rest," http://www.cabelas.com/cabelas/en/templates/links/link.jsp?id=0005819221954a&type=product&cmCat=, © 1996-2008, 2 pages [Internet accessed on Aug. 6, 2008].
Cabela's, "Elite Rifle Rest," http://www.cabelas.com/cabelas/en/templates/links/link.jsp?id=0005817227855a&type=product&cmCat=, © 1996-2008, 2 pp. [Internet accessed on Aug. 6, 2008].
Cabela's, "Sharp Shooter Auto Magnum Rifle Rest," http://www.cabelas.com/cabelas/en/templates/links/link.jsp?id=0054107229088a&type=product&cmCat=, © 1996-2008, 2 pages [Internet accessed on Aug. 6, 2008].
Cabela's, "Hyskore® Dangerous Game™ Machine Rest," http://www.cabelas.com/cabelas/en/templates/links/link.jsp?id=0044091228566a&type=product&cmCat=, © 1996-2008, 2 pages [Internet accessed on Aug. 6, 2008].
Cabela's, "Hyskore® Ultimate Sighting Rest," http://www.cabelas.com/cabelas/en/templates/links/link.jsp?id=0024152226083a&type=product&cmCat=, © 1996-2008, 2 pages [Internet accessed on Aug. 6, 2008].
MidwayUSA, "Caldwell Lead Sled Rifle Shooting Rest," http://www.midwayusa.com/eproductpage.exe/showproduct?saleitemid=152664&t=11082005, 2005, 8 pages [Internet accessed on Aug. 6, 2008].
MidwayUSA, "Caldwell Lead Sled DFT Rifle Shooting Rest," http://www.midwayusa.com/eproductpage.exe/showproduct?saleitemid=149023&t=11082005, 2005, 6 pages [Internet accessed on Aug. 6, 2008].
MidwayUSA, "Caldwell Full Length Fire Control Shooting Rest," http://www.midwayusa.com/eproductpage.exe/showproduct?saleitemid=683866&t=11082005, 2005, 3 pages [Internet accessed on Aug. 6, 2008].
MidwayUSA, "Caldwell Zero-Max Rifle Shooting Rest," http://www.midwayusa.com/eproductpage.exe/showproduct?saleitemid=726222&t=11082005, 2005, 3 pages [Internet accessed on Aug. 6, 2008].
MidwayUSA, "Caldwell Steady Rest NXT Rifle Shooting Rest," http://www.midwayusa.com/eproductpage.exe/showproduct?saleitemid=838651&t=11082005, 2005, 4 pages [Internet accessed on Aug. 6, 2008].
MidwayUSA, "ADG Rifle Shooting Rest," http://www.midwayusa.com/eproductpage.exe/showproduct?saleitemid=992071&t=11082005, 2005, 3 pages [Internet accessed on Aug. 6, 2008].
MidwayUSA, "CTK Precision P3 Ultimate Shooting Rest," http://www.midwaysusa.com/eproductpage.exe/showproduct?salemitemid=114699&t=11082005, 2005 2 pages [Internet accessed on Aug. 6, 2008].
MidwayUSA, "Stoney Point Bench Anchor Rifle Shooting Rest," http://www.midwayusa.com/eproductpage.exe/showproduct?saleitemid=347174&t=11082005, 2005, 2 pages [Internet accessed on Aug. 6, 2008].
MidwayUSA, "Shooters Ridge Steady Point Rifle Shooting Rest," http://www.midwayusa.com/eproductpage.exe/showproduct?saleitemid=826745&t=11082005, 2005, 5 pages [Internet accessed on Aug. 6, 2008].

MidwayUSA, "Shooters Ridge Steady Point Rifle Shooting Rest and Vise," http://www.midwayusa.com/eproductpage.exe/showproduct?saleitemid=341095&t=11082005, 2005, 4 pages [Internet accessed on Aug. 6, 2008].

MidwayUSA, "Hyskore® Precision Gas Dampened Recoil Reducing Rifle Shooting Rest," http://www.midwayusa.com/eproductpage.exe/showproduct?saleitemid=838848&t=11082005, 2005, 4 pages [Internet accessed on Aug. 6, 2008].

MidwayUSA, "Hyskore® Swivel Varmint Rifle Shooting Rest," http://www.midwayusa.com/eproductpage.exe/showproduct?saleitemid=587606&t=11082005, 2005, 3 pages [Internet accessed on Aug. 6, 2008].

MidwayUSA, "Hyskore® dangerous Game Rifle Shooting Rest," http://www.midwayusa.com/eproductpage.exe/showproduct?saleitemid=729197&t=11082005, 2005, 3 pages [Internet accessed on Aug. 6, 2008].

MidwayUSA, "Shooting Supplies—Shop Everything for Your Firearm at MidwayUSA," http://www.midwayusa.com/browse/BrowseProducts.aspx?categoryStrin..., 15 pages [I nternet accessed on Jul. 21, 2008].

Basspro.com, "Bass Pro Shops Outdoors Online: Offering the best in Fishing, Hunting and Outdoor Products," http://www.basspro.com/webapp/wcs/stores/servlet/Product_10151_-1_10001_95064_SearchResults, 2 pages [Internet accessed on Aug. 6, 2008].

Amazon.com, "CTK® P3 Ultimate Shooting Rest," Sports & Outdoors, http://www.amazon.com/CTK%C2%AE-P3-Ultimate-Shooting-Rest/dp/..., 1 page [Internet accessed on Jul. 22, 2008].

Amazon.com, "SHTRS RDG Steady PNT Rifle Rest DLX, Grips/Pads/Stocks, Gun Accessories, Hunting & Shooting Accessories, Hunting Gear, Fishing & Hunting," http://www.amazon.com/Steady-Accessories-Hunting-Shooting-Fishin..., 1 page [Internet accessed on Jul. 22, 2008].

Amazon.com, "Stoney Point Adjustable Shooting Rest w/Bag," Sports & Outdoors, http://www.amazon.com/Stoney-Point-Adjustable-Shooting-Rest/dp/B0.., 1 page [Internet accessed on Jul. 22, 2008].

CTK Precision, All Products, http://www.ctkprecision.com/index.asp?PageAction=VIEWCATS&Cate.., 3 pages [Internet accessed on Jul. 22, 2008].

CTK Precision, "P3 Ultimate Shooting Rest," http://www.ctkprecision.com/index.asp?PageAction=VIEWPROD&ProdOID=2, 3 pages [Internet accessed on Jul. 18, 2008].

Big Boy Gun Toys, "Shooting Rest," http://www.bigboyguntoys.com/shootingrest.htm, 1 page [Internet accessed on Jul. 18, 2008].

Boyt Harness Company, Product Catalog, http://www.boytharness.com/catalog/index.php?cPath=22, 2 pages [Internet accessed on Jul. 21, 2008].

Joe's, "Shooter's Ridge Steady Point Shooting Rest," http://www.joessport.com/productindex.jsp?productID=3155005&cp=726872&parentpag.., Item No. 3155005, 1 page [Internet accessed Jul. 17, 2008].

Cabela's, "Shooting Benches & Portable Rifle Shooting Bench Rest," http://www.cabelas.com/ssubcat-1/cat20793.shtml, 3 pages [Internet accessed Jul. 18, 2008].

"Gun Rest—Shooting Rest—Rifle Rests," http://www.jexploreproducts.com/gunrests-shootingrests.htm, 6 pages [Internet accessed Jul. 18, 2008].

E. Arthur Brown Company, "A Shooting Rest that Really Works..," http://www.eabco.com/TargetShooting01.html, © 2007-2008, 1 page [Internet accessed Jul. 18, 2008].

MacksPW.com, "Desert Mountain Bench Master Rifle Rest," http://www.macksqw.com/Item--i-DESBM1, © 2004-2008, 1 page [Internet accessed Jul. 22, 2008].

Hyskore, "Rest—Dangerous Game Machine Rest," Hyskore Rest, Professional firearm rests, http://www.hyskore.com/rests.htm, 2 pages [Internet accessed Jul. 21, 2008].

Shooters Ridge, "Shooting Rest with Gun Vise," http://www.shootersridge.com, 1 page [Internet accessed Jul. 17, 2008].

Shooters Ridge, "Deluxe Rifle Rest," http://www.shootersridge.com, 1 page [Internet accessed Jul. 21, 2008].

Chastain, R. "Load 'em Up!" About.com: Hunting/Shooting, http://hunting.about.com/od/reloadinfo/a/aaloademup_2htm, 6 pages [Internet accessed on Aug. 31, 2007].

Harris, J. et al., "The Art and Science of Annealing," http://www.6mmbr.com/annealing.html, © 2005, 13 pages [Internet accessed on Aug. 13, 2007].

Cork Industries, Inc., "Double Bumping Coating Applications," Cork Tech TalkNews, Feb. 1997, 2 pages.

Grafix® Plastics, http://www.grafixplastics.com/plastic_film_g.asp?gclid=CK-5-_7gnY4CFRVNhgodjFhfSQ, 29 pages [Internet accessed on Aug. 30, 2007].

International Search Report and Written Opinion; International Patent Application No. PCT/US07/76587; Filed: Aug. 22, 2007; Applicant: Battenfeld Technologies, Inc.; Mailed on Jul. 30, 2008.

International Search Report and Written Opinion; International Patent Application No. PCT/US07/83674; Filed: Nov. 5, 2007; Applicant: Battenfeld Technologies, Inc.; Mailed on Jun. 11, 2008.

Non-Final Office Action; U.S. Appl. No. 10/865,595; Mailed on Jun. 7, 2006, 8 pages.

Final Office Action; U.S. Appl. No. 10/865,595; Mailed on Apr. 3, 2007, 10 pages.

Non-Final Office Action; U.S. Appl. No. 11/339,863; Mailed on Sep. 23, 2008, 7 pages.

Non-Final Office Action; U.S. Appl. No. 11/206,430; Mailed on May 21, 2007, 12 pages.

Final Office Action; U.S. Appl. No. 11/206,430; Mailed on Oct. 29, 2007, 13 pages.

Non-Final Office Action; U.S. Appl. No. 11/206,430; Mailed on May 14, 2008, 10 pages.

Non-Final Office Action; U.S. Appl. No. 11/271,100; Mailed on Mar. 26, 2008, 9 pages.

Final Office Action; U.S. Appl. No. 11/271,100; Mailed on Sep. 22, 2008, 8 pages.

Non-Final Office Action; U.S. Appl. No. 11/311,530; Mailed on Feb. 13, 2007, 10 pages.

Non-Final Office Action; U.S. Appl. No. 11/505,784; Mailed on Dec. 26, 2007, 14 pages.

Non-Final Office Action; U.S. Appl. No. 11/507,683; Mailed on Sep. 18, 2008, 8 pages.

Non-Final Office Action; U.S. Appl. No. 11/679,136; Mailed on Aug. 18, 2008, 6 pages.

Non-Final Office Action; U.S. Appl. No. 11/679,136; Mailed on Aug. 28, 2008, 8 pages.

Non-Final Office Action; U.S. Appl. No. 11/844,980; Mailed on Aug. 21, 2008, 8 pages.

Non-Final Office Action; U.S. Appl. No. 11/846,408; Mailed on Aug. 18, 2008, 8 pages.

International Search Report and Written Opinion; International Patent Application No. PCT/US07/76440; Filed: Aug. 21, 2007; Applicant Battenfeld Technologies, Inc.; Mailed on Sep. 30, 2008.

Non-Final Office Action; U.S. Appl. No. 11/679,100; Mailed on Oct. 16, 2008, 11 pages.

U.S. Appl. No. 12/209,113, filed Sep. 11, 2008, Potterfield et al.

U.S. Appl. No. 12/276,223, filed Nov. 21, 2008, Potterfield et al.

U.S. Appl. No. 12/276,229, filed Nov. 21, 2008, Cauley et al.

"Cabela's Rotary Media Separator," http://www.cabelas/en/templates/links/link.jsp;jsessionid=QYVQMKM0P0P5.., 2 pages [Internet accessed Apr. 24, 2007].

Brass Cleaning Kits, http://www.berrysmfg.com/81.php, 1 page [Internet accessed Apr. 24, 2007].

Final Office Action; U.S. Appl. No. 11/206,430; Mailed on Nov. 24, 2008, 28 pages.

Final Office Action; U.S. Appl. No. 11/339,863; Mailed on Mar. 10, 2009, 22 pages.

Final Office Action; U.S. Appl. No. 11/505,784; Mailed on Dec. 19, 2008, 10 pages.

Non-Final Office Action; U.S. Appl. No. 11/418,407; Mailed on Feb. 24, 2009, 9 pages.

Non-Final Office Action; U.S. Appl. No. 11/431,956; Mailed on Mar. 2, 2009, 16 pages.

Non-Final Office Action; U.S. Appl. No. 11/607,550; Mailed on Mar. 2, 2009, 11 pages.

Non-Final Office Action; U.S. Appl. No. 11/801,341; Mailed on Jan. 13, 2009, 7 pages.
Non-Final Office Action; U.S. Appl. No. 11/853,763; Mailed on Dec. 22, 2008, 6 pages.
RCBS, "Reloading Equipment," http://www.rcbs.com/default.asp?menu=1&s1=4&s2=3&s3=25, 1 page [Internet accessed Apr. 24, 2007].
The Blue Press, "Dillon Case Preparation Equipment," http://dillonprecision.com/template/p.cfm?maj=16&min=0&dyn=1&, Apr. 2007, 2 pages [Internet accessed Apr. 24, 2007].
U.S. Appl. No. 12,476,041, filed Jun. 1, 2009, Cauley.
U.S. Appl. No. 12/578,393, filed Oct. 13, 2009, Morrow et al.
Final Office Action; U.S. Appl. No. 11/679,100; Mailed on Aug. 3, 2009, 9 pages.
Final Office Action; U.S. Appl. No. 11/679,136; Mailed on Apr. 10, 2009, 22 pages.
Final Office Action; U.S. Appl. No. 11/853,763; Mailed on Jul. 13, 2009, 7 pages.
Non-Final Office Action; U.S. Appl. No. 11/679,169; Mailed on Apr. 28, 2009, 11 pages.
Non-Final Office Action; U.S. Appl. No. 11/679,832; Mailed on Aug. 28, 2009, 9 pages.
Non-Final Office Action; U.S. Appl. No. 12/117,668; Mailed on Aug. 13, 2009, 15 pages.
Final Office Action; U.S. Appl. No. 11/801,341; Mailed on Sep. 30, 2009, 6 pages.
Non-Final Office Action; U.S. Appl. No. 11/206,430; Mailed on Jun. 23, 2009, 13 pages.
Non-Final Office Action; U.S. Appl. No. 11/739,077; Mailed on Oct. 8, 2009, 7 pages.
Non-Final Office Action; U.S. Appl. No. 12/209,113; Mailed on Sep. 23, 2009, 6 pages.
Final Office Action; U.S. Appl. No. 11/607,550; Mailed on Nov. 27, 2009, 14 pages.
Non-Final Office Action; U.S. Appl. No. 11/505,784; Mailed on Oct. 27, 2009, 8 pages.
Non-Final Office Action; U.S. Appl. No. 12/476,041; Mailed on Nov. 18, 2009, 6 pages.

* cited by examiner

MODULAR SHOOTING RESTS AND SHOOTING REST ASSEMBLIES

CROSS-REFERENCE TO RELATED APPLICATION(S)

This application claims the benefit of U.S. Provisional Patent Application No. 60/843,971, filed Sep. 11, 2006, and which is incorporated herein by reference.

TECHNICAL FIELD

The present disclosure is directed generally to modular shooting rests and associated assemblies.

BACKGROUND

Shooters often use firearm rests or supports to steady a firearm during operation (e.g., target practice, accuracy testing, etc.). Holding a firearm without a stable support may not provide the required repeatability to determine the accuracy of the firearm. Many shooters accordingly use a support in an attempt to reduce or eliminate human movement inherent from holding the firearm. For example, shooters may place a front or forestock portion of a rifle on a front portion of a firearm support and a rear or buttstock portion of the rifle on a rear portion of the support. Alternatively, shooters may hold the buttstock and use a support only for the forestock portion of the rifle. To provide a desired level of stability for the shooter, many conventional firearm supports are bulky devices with a large, generally fixed length and height.

DETAILED DESCRIPTION

A. Overview

Figure 1A:
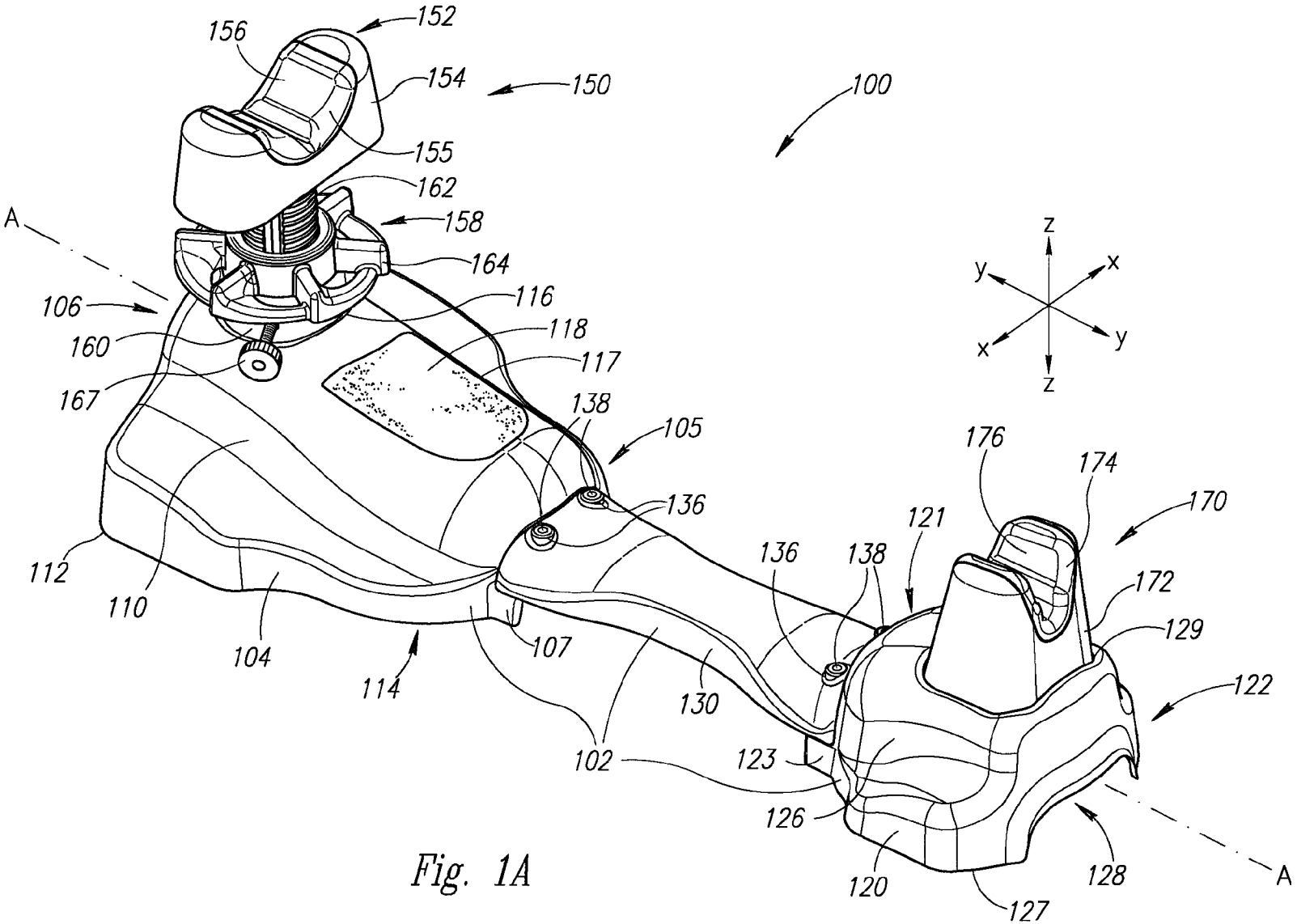
FIG. 1A is a front isometric view of a modular shooting rest configured in accordance with one embodiment of the disclosure.

The following disclosure describes several embodiments of modular shooting rests and associated assemblies. One embodiment of the disclosure, for example, is directed to a shooting rest assembly for supporting a firearm. The shooting rest assembly can include a first base portion and a second base portion. The first base portion has an exterior surface, an inner surface, and a bottom surface defining a bottom surface plane. The first base portion also includes an inner volume defined, at least in part, by the inner surface and the bottom surface plane. The second base portion is engaged with the first base portion in a configuration selected from (a) a first shooting rest arrangement, and (b) a second shooting rest arrangement. In the first shooting rest arrangement, the second base portion is received at least approximately completely within the inner volume of the first base portion in a nested configuration. In the second shooting rest arrangement, the first base portion is positioned to support a first section of the firearm and the second base portion is positioned to support a second section of the firearm.

Another aspect of the disclosure is directed to methods of packaging shooting rests for supporting firearms having a first section and a second section spaced apart from the first section. In one embodiment, for example, a method includes providing a first base portion and a second base portion attachable to the first base portion. The method also includes providing a first support configured to project from the first base portion and support the first section of the firearm, and a second support configured to project from the second base portion and support the second section of the firearm. The method further includes placing the first and second base portions and the first and second supports in a container with the second base portion and a component from the first support and/or the second support at least approximately completely received by the first base portion in a nested configuration.

Specific details of several embodiments of the disclosure are set forth in the following description and in FIGS. 1A-4 to provide a thorough understanding of these embodiments. A person skilled in the art, however, will understand that the disclosure may be practiced without several of these details or additional details can be added to the disclosure. Several details describing well-known structures or processes often associated with firearms and firearm supporting devices have not been shown or described in detail to avoid unnecessarily obscuring the description of the embodiments of the disclosure. Where the context permits, singular or plural terms may also include the plural or singular term, respectively. Moreover, unless the word "or" is expressly limited to mean only a single item exclusive from the other items in reference to a list of two or more items, the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same feature and/or additional types of features are not precluded.

B. Embodiments of Modular Shooting Rests and Associated Assemblies

Figure 1B:
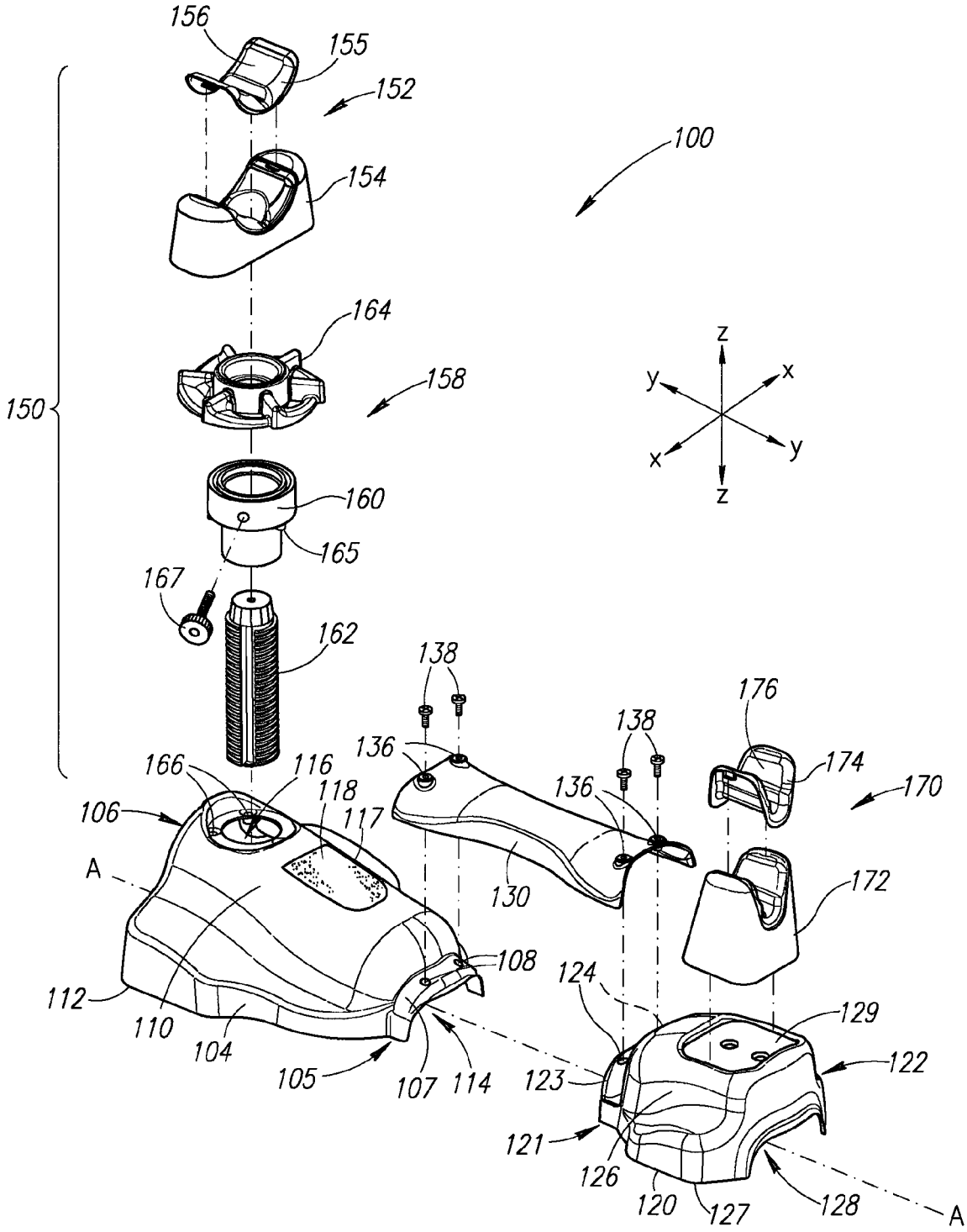
FIG. 1B is an exploded isometric view of the modular shooting rest of FIG. 1A.

FIG. 1A is a front isometric view and FIG. 1B is an exploded isometric view of a modular shooting rest or firearm supporting device 100 configured in accordance with one embodiment of the disclosure. Referring to FIGS. 1A and 1B together, the illustrated shooting rest 100 can support a firearm (e.g., rifle or shotgun) at one or more points on the firearm during operation. The shooting rest 100 in the illustrated embodiment includes a base 102, a first or front support 150 for carrying a forward portion of a firearm (e.g., a forestock of a rifle), and a second or rear support 170 for carrying a rearward portion of the firearm (e.g., a buttstock of the rifle). In one aspect of the illustrated embodiment, the components of the shooting rest 100 may be disassembled when not in use to facilitate storage, shipping, and/or transport of the shooting rest 100. In several embodiments, for example, a number of the disassembled components may be nested within each other in a stacked configuration to reduce the space occupied by these components. Further details regarding this process and examples of such nested and stacked arrangements for the shooting rest 100 are described in greater detail below.

The illustrated base 102 has a longitudinal axis A-A, a first base portion 104 attached to the first support 150, a second base portion 120 attached to the second support 170, and a third base portion 130 attached to and positioned between the first and second base portions 104 and 120. The first, second, and third base portions 104, 120, and 130 are separate and distinct components of the base 102 that can be assembled and attached together for use in a desired arrangement. As mentioned above, for example, the first, second, and third base portions 104, 120, and 130 are configured to be releasably connected such that the portions 104, 120, and 130 can be detached from each other and nested together for moving, storage, or other purposes. When the first, second, and third base portions 104, 120, and 130 are attached together, however, the portions 104, 120, and 130 are fixed and non-movable relative to each other.

The first base portion 104 has a longitudinal axis generally coaxial with the axis A-A of the base 102, a first end section 105 attached to the third base portion 130, and a second end section 106 opposite the first end section 105. In the illustrated embodiment, the first end section 105 includes a flange 107 configured to interface with a corresponding region on the third base portion 130. The flange 107 can also include one or more apertures 108 (two are shown in the illustrated embodiment) aligned with corresponding apertures 136 in the third base portion 130. Fasteners 138 can be placed in the apertures 108 and 136 to releasably attach the first base portion 104 to the third base portion 130. The fasteners 138 can include, for example, thumbscrews that can be installed and uninstalled by hand without tools. In other embodiments, however, the fasteners 138 can include other suitable types of fasteners (e.g., screws, bolts, rivets, etc.) that can be selectively installed/uninstalled with or without tools.

The first base portion 104 also includes an upper or exterior surface 110, an inner surface (not shown—see FIGS. 2B and 2C), and a bottom surface 112. The bottom surface 112 and the inner surface define, at least in part, a cavity 114 configured to receive one or more components of the shooting rest 100 in a nested and stacked arrangement. The cavity 114 is described in greater detail below with reference to FIGS. 2B and 2C. As best seen in FIG. 1B, the first base portion 104 also includes an opening or aperture 116 sized and positioned to receive at least a portion of the first support 150. The first base portion 104 may also include a non-marring member 117 attached to the upper surface 110. The non-marring member 117 can be a pliable, rubber-like material to provide a slip-resistant contact surface 118 and prevent marring of the firearm. The non-marring member 117 is an optional component that may not be included in some embodiments.

The second base portion 120 has a longitudinal axis generally coaxial with the axis A-A of the base 102, a first end section 121 attached to the third base portion 130, and a second end section 122 opposite the first end section 121. The first end section 121 includes a similar arrangement as the first end section 105 of the first base portion 104. Accordingly, the second base portion 120 can be attached to the third base portion 130 in a manner similar to the connection between the first base portion 104 and the third base portion 130. For example, the first end section 121 includes a flange 123 configured to interface with a corresponding region on the third base portion 130, and one or more apertures 124 (two are shown) aligned with corresponding apertures 136 in the third base portion 130. Fasteners 138 can be placed in the apertures 124 and 136 to releasably attach the second base portion 120 to the third base portion 130. In other embodiments, the second base portion 120 can be releasably attached to the third base portion 130 via other mechanisms.

The second base portion 120 also includes an upper or exterior surface 126, an inner surface (not shown), and a bottom surface 127. As with the first base portion 104 described above, the bottom surface 127 and the inner surface of the second base portion 120 define, at least in part, a cavity 128 configured to receive one or more components of the shooting rest 100 in a nested and stacked arrangement. The upper surface 126 can also include a mounting or attachment region 129 at the second end section 122 and configured to receive the second support 170.

The third base portion 130 is a bridge or frame portion configured to releasably connect the first base portion 104 to the second base portion 120, and provide stability to the shooting rest 100. In other embodiments, the third base portion 130 can have a different configuration and/or include different features. Furthermore, the third base portion 130 is an optional component that may not be included in some shooting rest configurations, such as the configurations described below with reference to FIGS. 3 and 4.

The first or front support 150 is attached to the first base portion 104 at the second end section 106 and projects from the upper surface 110. The first support 150 is a modular component that may be detached or removed from the first base portion 104. In other embodiments, however, the first support 150 may be attached to the first base portion 104 in a fixed or non-removable arrangement.

The first support 150 includes a rest assembly 152 and a height adjustment or elevation assembly 158 configured to move the first support 150 in the z-direction. The rest assembly 152 can include, for example, a body 154, a non-marring member 155 attached to the body 154, and a contact surface 156 on the non-marring member 155. The non-marring member 155 can be a pliable, rubber-like material to prevent marring of the firearm and provide the slip-resistant contact surface 156. The body 154 and the non-marring member 155 can have a generally V-shaped configuration sized to receive the forward portion of the firearm. The generally V-shaped configuration centers the firearm and inhibits side-to-side movement of the firearm. In other embodiments, the rest assembly 152 may have a different configuration and/or include other features.

The height adjustment assembly 158 can include a collar or shoulder portion 160, a threaded shaft or ram 162, and an elevation adjustment dial or wheel 164. As best seen in FIG. 1B, the collar 160 is configured to interface with the opening 116 in the first base portion 104 and releasably hold the height adjustment assembly 158 in place relative to the first base portion 104. The collar 160, for example, can include one or more interface portions 165 configured to engage corresponding interface portions 166 adjacent to the opening 116, and one or more fasteners (not shown) can be used to releasably secure the collar 160 to the first base portion 104. In other embodiments, the collar 160 can be coupled to the first base portion 104 using other suitable mechanisms. The shaft 162 is received by the collar 160 and can be held in place using one or more fasteners 167 (e.g., thumbscrews). The adjustment dial 164 is threadably engaged with the shaft 162. When the adjustment dial 164 is rotated, the shaft 162 moves in the z-direction and, accordingly, moves the rest assembly 152 in the z-direction to a desired elevation. In other embodiments, the height adjustment assembly 158 may have a different configuration or the first support 150 may not include a height adjustment assembly 158.

The second or rear support 170 is coupled to the second base portion 120 at the mounting or attachment region 129. In the illustrated embodiment, the second support 170 includes a body 172, a non-marring member 174 attached to the body 172, and a contact surface 176 on the non-marring member 174. The non-marring member 174 can be generally similar to the non-marring member 155 described above. Furthermore, similar to the rest assembly 152 described above, the body 172 and the non-marring member 174 of the second support 170 can have a generally V-shaped configuration sized to receive the rearward portion (e.g., a buttstock) of the firearm. In other embodiments, the second support 170 may have a different configuration and/or include other features.

A number of the components of the shooting rest 100 may be manufactured as separate components and composed of a thermoset material shaped in an injection molding process. For example, the base portions 104, 120, and 130, and one or more portions of the first support 150 and the second support 170 may be formed from the thermoset material using a molding process. In other embodiments, however, one or more of the components may be composed of another type of material and/or formed using a different process.

Figure 2A:
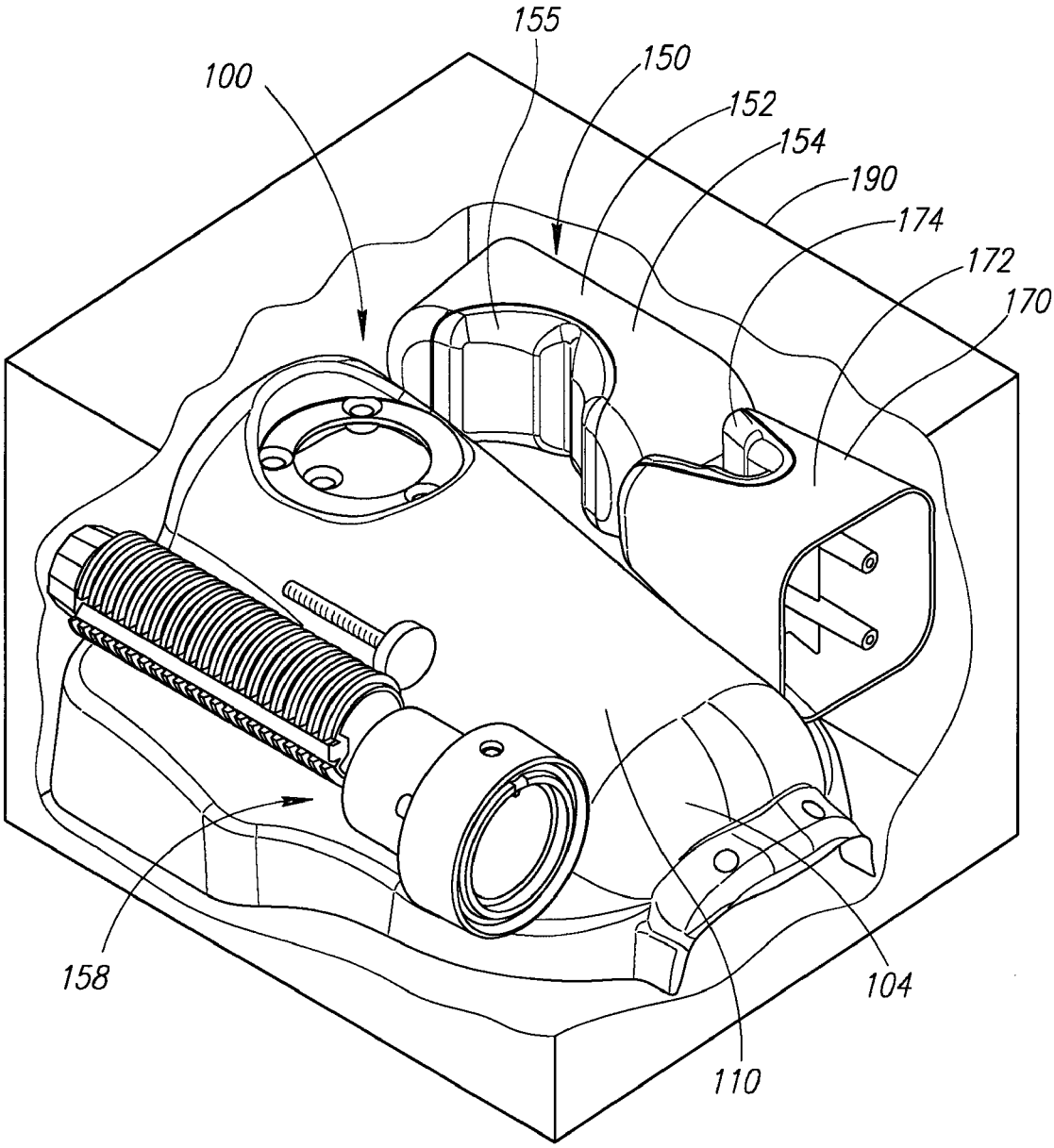
FIG. 2A is a front isometric view of a modular shooting rest with a number of the shooting rest components nested within each other in a stacked configuration and positioned within a container in accordance with one embodiment of the disclosure.
Figure 2B:
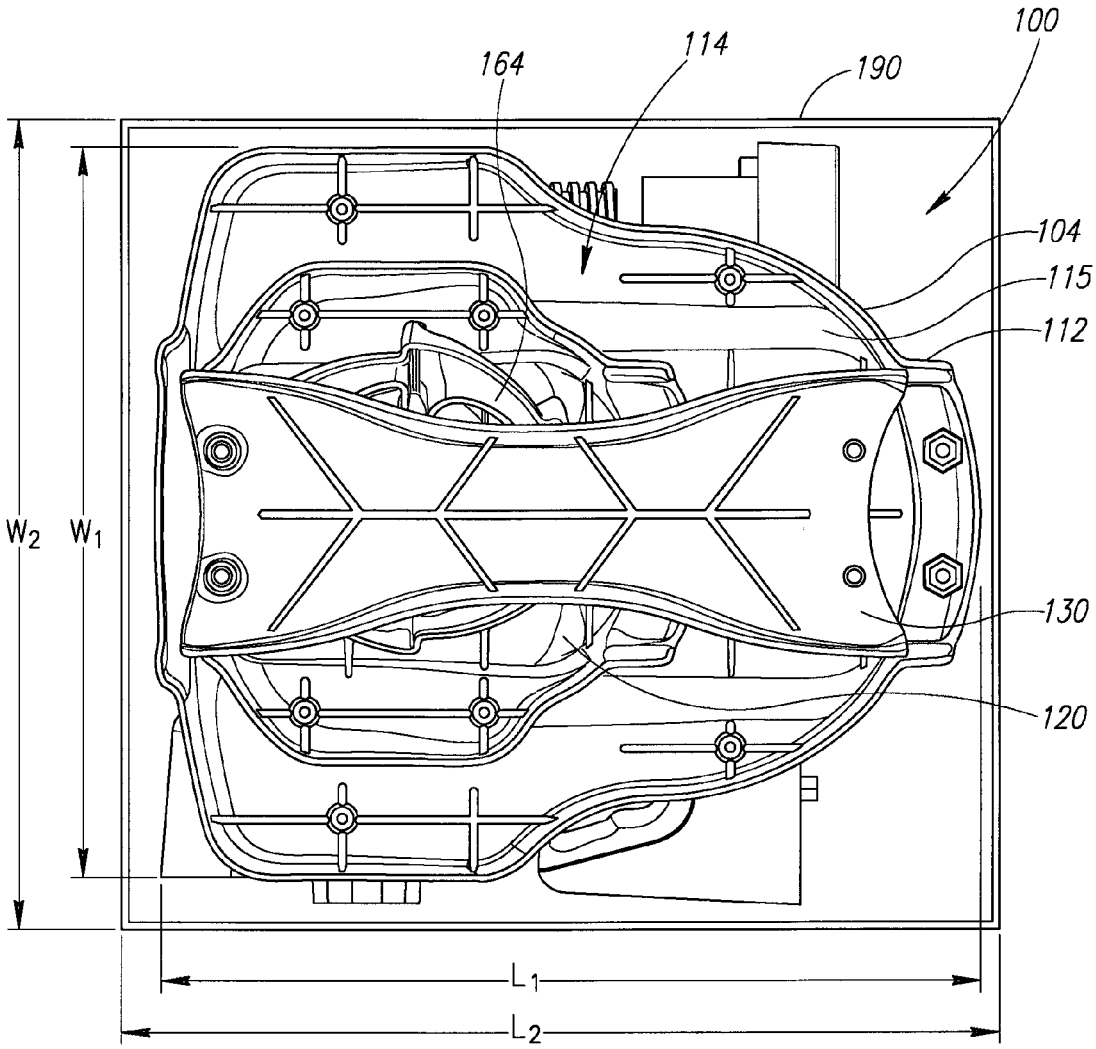
FIG. 2B is a bottom plan view of the modular shooting rest of FIG. 2A.
Figure 2C:
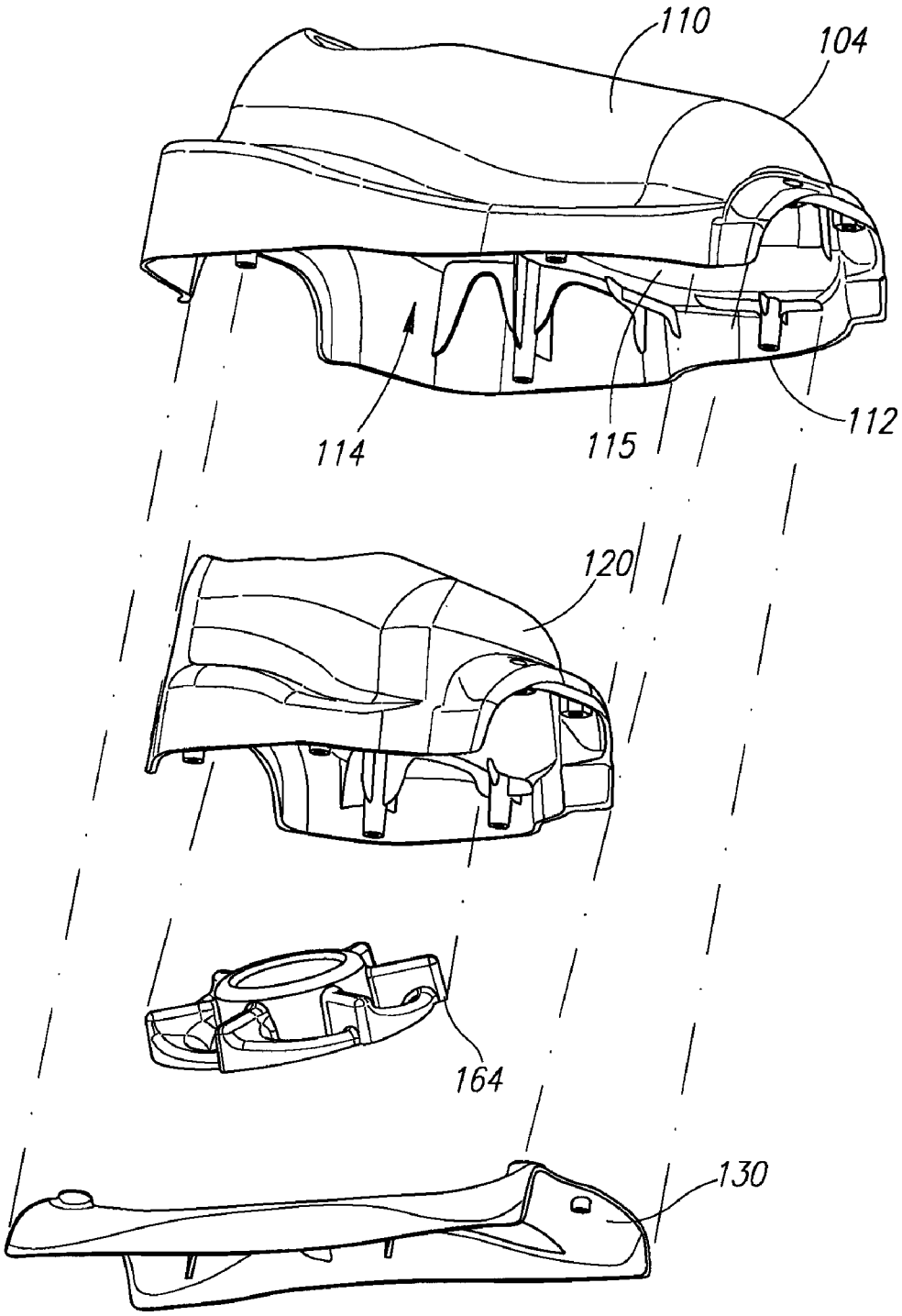
FIG. 2C is an exploded, bottom isometric view of a portion of the modular shooting rest configuration illustrated in FIG. 2A.

In the embodiment shown in FIG. 1A, the shooting rest 100 is in an operational or assembled configuration. As mentioned previously, however, a number of the components of the shooting rest 100 may be nested within each other in a stacked configuration to facilitate storage and transport of the shooting rest. FIGS. 2A-2C illustrate several examples of such nested and stacked configurations.

FIG. 2A, for example, is a partially schematic, front isometric view of the various components of the shooting rest 100 arranged in a nested, compact configuration for storage in a container 190 (shown schematically with a cut-away portion) in accordance with one embodiment of the disclosure. In the illustrated embodiment, a number of the components of the shooting rest 100 are detached from each other and positioned within the container 190 (e.g., a box) for storage, shipping to a customer, distributor, or store for retail sale, or other purposes. For example, the individual components of the first support 150 (e.g., the rest assembly 152 and the height adjustment assembly 158) are detached from each other and the first base portion 104 and positioned at a desired location adjacent to the upper surface 110 of the first base portion 104. The second support 170 is also detached from the second base portion 120 (FIGS. 1A and 1B) and positioned at a desired location adjacent to the upper surface 110 and the various components of the first support 150. Although the rest assemblies 152 and 172 are shown at least partially assembled in the illustrated embodiment (e.g., the non-marring members 155 and 174 are attached to the body portions 154 and 172, respectively), in other embodiments, the rest assembly components may not be assembled. Further, in still other embodiments, the first and/or second supports 150 and 170 may have a different arrangement relative to each other and/or the first base portion 104 within the container 190. The remaining components of the shooting rest 100 are nested within the first base portion 104, as described in greater detail below with reference to FIGS. 2B and 2C.

FIG. 2B is a partially schematic, bottom plan view of the shooting rest configuration shown in FIG. 2A, and FIG. 2C is an exploded, bottom isometric view of a portion of the components shown in FIG. 2B. The container 190 and a number of shooting rest components are not illustrated in FIG. 2C merely to simplify the illustration. Referring to FIGS. 2B and 2C together, the second base portion 120, the third base portion 130, and the adjustment dial 164 are nested within the cavity 114 of the first base portion 104 in a stacked configuration. As mentioned previously, the cavity 114 is defined, at least in part, by an inner surface 115 of the first base portion 104 and a plane generally coplanar with the bottom surface 112. The cavity 114 can be sized and configured such that the second base portion 120, the third base portion 130, and the adjustment dial 164 are completely or at least approximately completely received within an inner volume of the cavity 114. In other embodiments, the individual components may have a different nesting configuration within the cavity 114 of the first base portion 104 and/or one or more different components may be nested within the cavity 114.

One advantage of nesting at least a portion of the shooting rest components within the cavity 114 of the first base portion 104 is that the components can fit within a much smaller container for storage and/or transport than the large and relatively bulky containers required for conventional shooting rests. Referring to FIG. 2B, for example, the first base portion 104 has a footprint including a length $L_1$ and a width $W_1$. When disassembled, at least approximately all the components of the shooting rest 100 can generally fit within the area defined with the length $L_1$ and the width $W_1$ of the first base portion 104. The container 190 accordingly only has to have a length $L_2$ and a width $W_2$ slightly larger than the length $L_1$ and width $W_1$ to accommodate the shooting rest 100. In one particular embodiment, for example, the container 190 has a length $L_2$ of about 12 inches and a width $W_2$ of about 10.5 inches. This feature is expected to significantly reduce the costs associated with packaging and shipping the shooting rest 100 to consumers and retailers because shipping rates are based in part on the volume of the container 190. In other embodiments, the first base portion 104 and/or the container 190 can have different dimensions.

C. Additional Embodiments of Modular Shooting Rests

Figure 3:
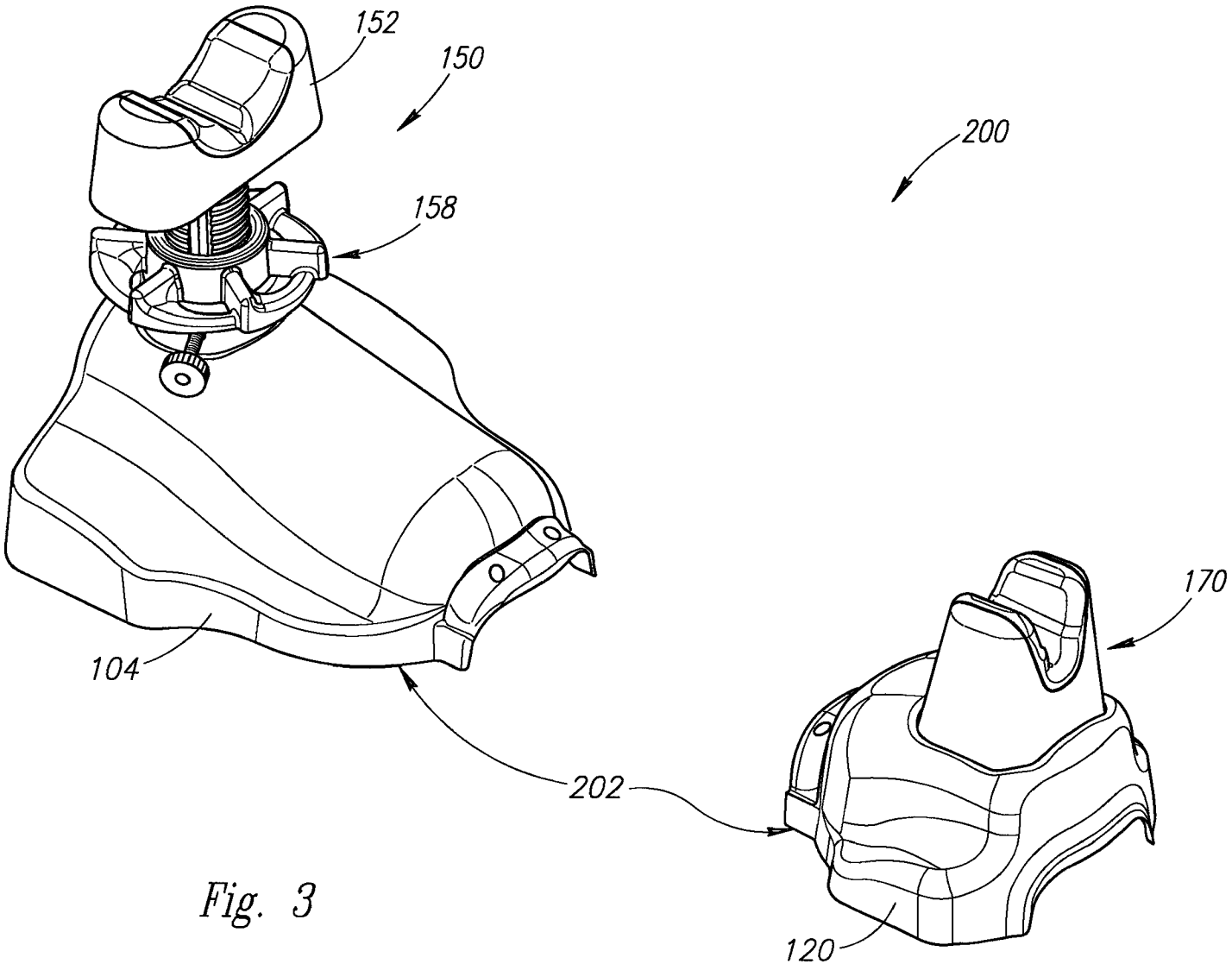
FIG. 3 is a front isometric view of a modular shooting rest configured in accordance with another embodiment of the disclosure.
Figure 4:
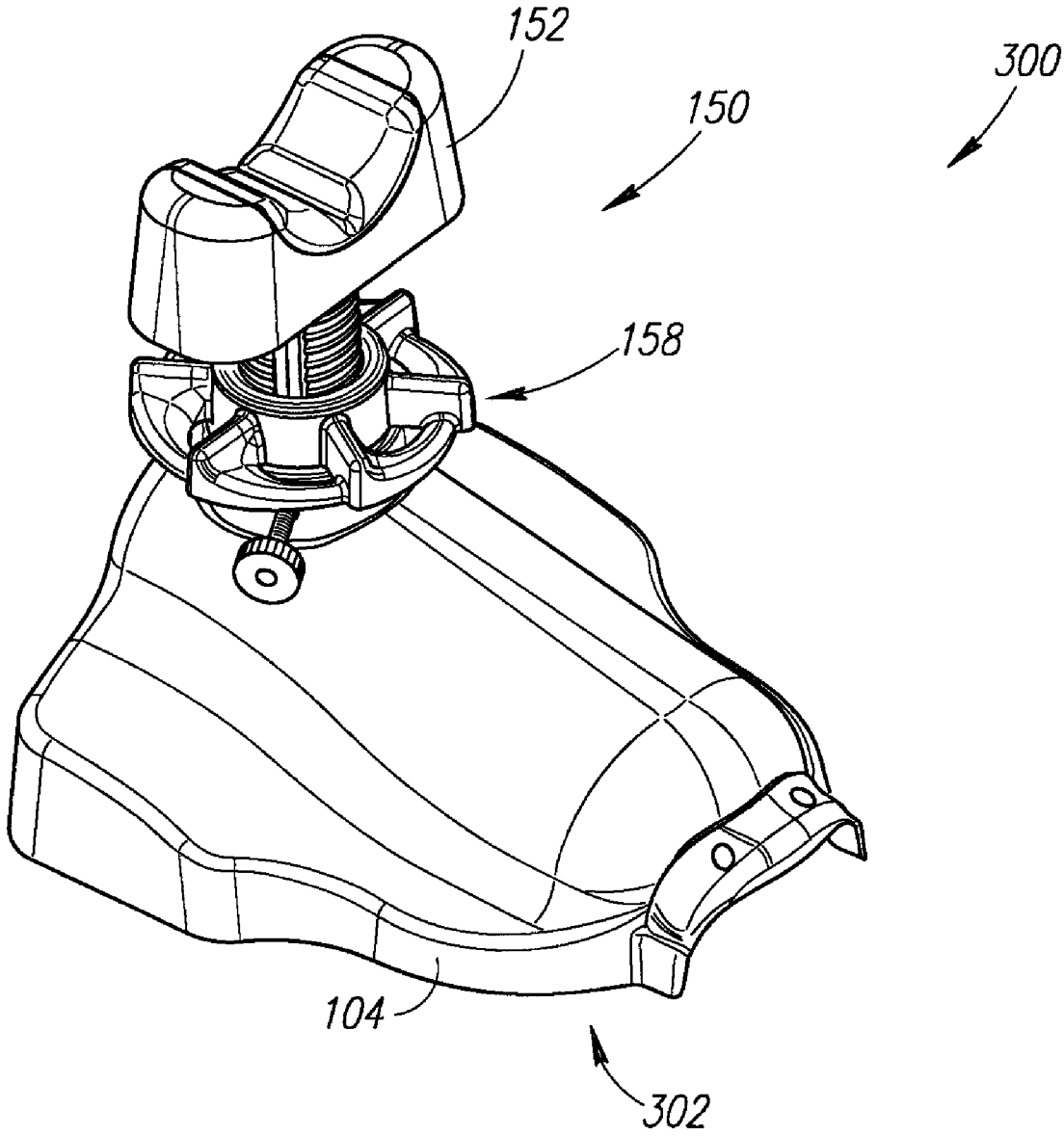
FIG. 4 is a front isometric view of a modular shooting rest configured in accordance with still another embodiment of the disclosure.

FIGS. 3 and 4 illustrate modular shooting rests or firearm support devices configured in accordance with additional embodiments of the disclosure. These assemblies can include several features generally similar to the shooting rest 100 described above with reference to FIGS. 1A-2C. Accordingly, like reference numbers refer to like components in FIGS. 1A-2C and FIGS. 3 and 4. The shooting rests described below can also have many of the same advantages as the shooting rest 100 described above.

FIG. 3, for example, is a front isometric view of a modular shooting rest 200 configured in accordance with another embodiment of the disclosure. The shooting rest 200 is generally similar to the shooting rest 100 described above with reference to FIGS. 1A and 1B. For example, the shooting rest 200 includes a base 202 having the first base portion 104 and the second base portion 120. The shooting rest 200 also includes (a) the first support 150 carried by the first base portion 104, and (b) the second support 170 carried by the second base portion 120. The shooting rest 200 differs from the shooting rest 100 described above in that the shooting rest 200 does not include the third base portion 130 (FIGS. 1A and 1B) connecting the first base portion 104 to the second base portion 120. Instead, the first base portion 104 and the second base portion 120 of the shooting rest 200 can be moved to a variety of locations relative to each other to support at least two points on a firearm during operation. One advantage of the shooting rest 200 is that the first and second base portions 104 and 120 can be moved relative to each other to accommodate firearms (e.g., rifles and shotguns) having a variety of different sizes and/or configurations.

FIG. 4 is a front isometric view of a modular shooting rest 300 configured in accordance with still another embodiment of the disclosure. The shooting rest 300 differs from the shooting rests 100 and 200 described above in that the shooting rest 300 only includes a single point of support for a firearm (e.g., a rifle, shotgun, and/or handgun). More specifically, the shooting rest 300 includes a base 302 including only the first base portion 104. The first support 150 is carried by the first base portion 104. In situations in which the shooting rest 300 is used with a handgun, the non-marring member 117 at the upper surface 110 of the first base portion 104 can provide a slip-resistant surface to support and stabilize the handgun, while preventing marring of the firearm. As mentioned previously, however, the non-marring member 117 is an optional component that may not be included in some embodiments.

In either of the embodiments described above with reference to FIGS. 3 and 4, the unused components of the shooting rest assembly (e.g., the third base portion 130, the second base portion 120 in the embodiment shown in FIG. 4, etc.) can be nested and stored within the cavity 114 in the first base portion 104 during operation. In other embodiments, however, the unused components may be stored in another location. Furthermore, the shooting rests 200 and 300 described above may include other features and/or have configurations different than those shown in the illustrated embodiments. For example, in several embodiments the first support 150 may not include the height adjustment assembly 158.

From the foregoing, it will be appreciated that specific embodiments of the disclosure have been described herein for purposes of illustration, but that various modifications can be made without deviating from the spirit and scope of the disclosure. For example, the container 190 (FIG. 2A) may have other configurations and/or include other suitable packaging assemblies (e.g., plastic clamshell packaging, shrink-wrapped packaging, etc.). Moreover, specific elements of any of the foregoing embodiments can be combined or substituted for elements in other embodiments. Furthermore, while advantages associated with certain embodiments of the disclosure have been described in the context of these embodiments, other embodiments may also exhibit such advantages, and not all embodiments need necessarily exhibit such advantages to fall within the scope of the invention. Accordingly, embodiments of the disclosure are not limited except as by the appended claims.

We claim:

1. A shooting rest assembly for supporting a firearm having a first section and a second section spaced apart from the first section, the shooting rest assembly comprising:

a first base portion having an exterior surface, an inner surface, a bottom surface defining a bottom surface plane, and an inner volume defined at least in part by the inner surface and the bottom surface plane;

a second base portion engaged with the first base portion in a configuration selected from a first shooting rest arrangement and a second shooting rest arrangement; and a third base portion, wherein the first shooting rest arrangement includes the second base portion and the third base portion received at least approximately completely within the inner volume of the first base portion in a nested configuration; and the second shooting rest arrangement includes the first base portion positioned to support the first section of the firearm, the second base portion positioned to support the second section of the firearm, and the third base portion positioned relative to the first base portion and the second base portion.

2. The shooting rest assembly of claim 1, further comprising:

a first support carried by and projecting from the first base portion; and a second support carried by and projecting from the second base portion, and wherein in the second shooting rest arrangement, the first support is positioned to carry the first section of the firearm and the second support is positioned to carry the second section of the firearm.

3. The shooting rest assembly of claim 2 wherein:

the first support comprises (a) a first rest assembly for supporting the first section of the firearm and selectively inhibiting movement of the first section of the firearm relative to the first base portion, and (b) an elevation adjustment assembly configured to adjust a position of the rest assembly relative to the first base portion; and the second support comprises a second rest assembly for supporting the second section of the firearm and selectively inhibiting movement of the second section of the firearm relative to the second base portion.

4. The shooting rest assembly of claim 1 wherein:

the first portion of the base comprises a first axis; and the second portion of the base comprises a second axis, and wherein in the second shooting rest arrangement, the first and second axes are generally coaxial.

5. The shooting rest assembly of claim 1, wherein the third base portion is configured to be attached to the first and second base portions and positioned between the first and second base portions.

6. The shooting rest assembly of claim 5, further comprising a plurality of fasteners connecting the third base portion to the first and second base portions, and wherein the fasteners are configured for installation and uninstallation by hand without the use of any tools.

7. The shooting rest assembly of claim 5, further comprising at least one flange attaching the first base portion to the third base portion.

8. The shooting rest assembly of claim 1 wherein the first base portion and the second base portion are composed of a thermoset material.

9. The shooting rest assembly of claim 1, further comprising a container having an inner volume, and wherein:

in the first shooting rest arrangement, the first and second base portions are configured to fit completely within the inner volume of the container; and in the second shooting rest arrangement, the first base portion and the second base portion are connected to the third portion, and wherein the resulting shooting rest assembly does not fit completely within the inner volume of the container.

10. The shooting rest assembly of claim 9 wherein the container has a length of about 12 inches and a width of about 10.5 inches.

11. The shooting rest assembly of claim 1 wherein in the second shooting rest arrangement, the first base portion is movable relative to the second base portion.

12. The shooting rest assembly for supporting a firearm having a first section and a second section spaced apart from the first section, the shooting rest assembly comprising:

a first base portion having an exterior surface, an inner surface, a bottom surface defining a bottom surface plane, and an inner volume defined at least in part by the inner surface and the bottom surface plane;

a second base portion engaged with the first base portion in a configuration selected from a first shooting rest arrangement and a second shooting rest arrangement, wherein the first shooting rest arrangement includes the second base portion received at least approximately completely within the inner volume of the first base portion in a nested configuration;

the second shooting rest arrangement includes the first base portion positioned to support the first section of the firearm and the second base portion positioned to support the second section of the firearm; and a third base portion configured to be attached to the first and second base portions and positioned between the first and second base portions; wherein in the first shooting rest arrangement, the third base portion is received at least approximately completely within the inner volume of the first base portion in a nested configuration with the second base portion; and in the second shooting rest arrangement, the third base portion is positioned between the first and second base portions and connects the first base portion to the second base portion.

13. A firearm supporting device for supporting a firearm, the firearm supporting device comprising:

a base including a front portion, a frame portion, and a rear portion, wherein the front base portion has a first footprint and the rear base portion has a second footprint smaller than the first footprint;

a front support attachable to the front portion of the base, the front support being configured to support a front section of a firearm; and a rear support attachable to the rear portion of the base and configured to support a rear section of the firearm, wherein the firearm supporting device is reconfigurable between a non-operational arrangement and an operational arrangement to support the firearm, and wherein in the non-operational arrangement the rear base portion and the frame are positioned relative to the front base portion and within the first footprint in a nested and stacked configuration.

14. The firearm supporting device of claim 13 wherein the individual base portions are separate, distinct components releasably attachable to each other in a desired arrangement.

15. The firearm supporting device of claim 13 wherein:

the front support comprises a first generally V-shaped assembly having a non-marring support surface for supporting the front section of the firearm, and a height adjustment assembly to change a position of the support surface relative to the front base portion; and the rear support comprises a second generally V-shaped assembly having a non-marring support surface for supporting the rear section of the firearm.

16. The firearm supporting device of claim 13 wherein the front base portion includes a first axis, the rear base portion includes a second axis, and the frame includes a third axis, and wherein:

in the operational arrangement, the first, second, and third axes are generally coaxial; and in the non-operational arrangement, the first, second, and third axes are non-coaxial and generally parallel.

17. A method of packaging a shooting rest for supporting a firearm having a first section and a second section spaced apart from the first section, the method comprising:

providing a first base portion, a second base portion attachable to the first base portion, a first support configured to project from the first base portion and support the first section of the firearm, and a second support configured to project from the second base portion and support the second section of the firearm;

placing the first and second base portions and the first and second supports in a container with the second base portion at least approximately completely received by the first base portion in a nested configuration; and providing a third base portion configured to be attached to the first and second base portions and positioned between the first and second base portion; and placing the third base portion in the container with the third base portion at least approximately completely received by the first base portion in a nested configuration.

18. The method of claim 17 wherein:

providing the first base portion comprises providing the first base portion having a first length and the second base portion having a second length less than the first length; and placing the first and second base portions in a container comprises placing the first and second base portions in a container having a third length, and wherein the third length is less than a minimum length of the base when the first and second base portions are attached together.

19. The method of claim 17 wherein:

providing a first support comprises providing a first support having a rest assembly and an elevation assembly configured to change a position of the rest assembly relative to the first base portion;

placing the first and second base portions and the first and second supports in a container comprises placing the second base portion and at least a portion of the elevation assembly at least approximately completely within an inner volume of the first base portion in a nested configuration.

* * * * *